US006251577B1

(12) United States Patent
Sakurazawa et al.

(10) Patent No.: US 6,251,577 B1
(45) Date of Patent: Jun. 26, 2001

(54) METHOD OF MANUFACTURING SILVER HALIDE PHOTOGRAPHIC EMULSION, SILVER HALIDE PHOTOGRAPHIC EMULSION MANUFACTURED BY THE METHOD, AND METHOD OF INHIBITING AGGREGATION OF THE EMULSION

(75) Inventors: Mamoru Sakurazawa; Junichiro Hosokawa; Keiji Mihayashi, all of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/266,941

(22) Filed: Mar. 12, 1999

(30) Foreign Application Priority Data

Mar. 12, 1998 (JP) ..... 10-078551

(51) Int. Cl.[7] ..... G03C 1/015

(52) U.S. Cl. ..... 430/569; 430/567; 430/581; 430/583; 430/642

(58) Field of Search ..... 430/569, 581, 430/583, 642, 567

(56) References Cited

U.S. PATENT DOCUMENTS 5,130,212 * 7/1992 Morimoto et al. ..... 430/569
5,496,691 * 3/1996 Miyamoto et al. ..... 430/539
5,637,446 * 6/1997 Yamashita ..... 430/567

FOREIGN PATENT DOCUMENTS

4404003A1 8/1995 (DE) .
0590715 4/1994 (EP) .
3174142 7/1991 (JP) .
6332091 2/1994 (JP) .
8272021 10/1996 (JP) .

* cited by examiner

*Primary Examiner*—Mark F. Huff
*Assistant Examiner*—Amanda C. Walke
(74) *Attorney, Agent, or Firm*—Birch, Stewart, Kolasch & Birch, LLP.

(57) ABSTRACT

A method for producing a silver halide photographic emulsion comprises a step of spectrally sensitizing a silver halide photographic emulsion material that contains tabular silver halide grains having an aspect ratio of 3 or more in an amount of 50% or more of the total projected area of all the silver halide grains, and a step of performing the spectral sensitization by the addition of a cyanine dye in an amount of 60% or more of the saturated covering amount of the silver halide grains, and the emulsion is produced in the presence of 400 to 2,500 ppm of calcium ions and/or 50 to 2,500 ppm of magnesium ions.

14 Claims, 1 Drawing Sheet

METHOD OF MANUFACTURING SILVER HALIDE PHOTOGRAPHIC EMULSION, SILVER HALIDE PHOTOGRAPHIC EMULSION MANUFACTURED BY THE METHOD, AND METHOD OF INHIBITING AGGREGATION OF THE EMULSION

BACKGROUND OF THE INVENTION

The present invention relates to a silver halide photographic emulsion, a method of manufacturing the emulsion, and a method of inhibiting aggregation of the emulsion. The present invention particularly relates to a silver halide photographic emulsion which is spectrally sensitized by adding a cyanine dye and in which tabular grains having an aspect ratio of 3 or more account for 50% or more of the total projected area, a method of manufacturing the emulsion, and a method of inhibiting aggregation of the emulsion.

Silver halide photographic emulsions are generally manufactured through grain formation, desalting, spectral sensitization, and chemical sensitization. To improve the sensitivity/graininess ratio of a silver halide photographic emulsion, spectral sensitization using a sensitizing dye is recently generally performed by adding the sensitizing dye during or before chemical sensitization, as disclosed in, e.g., U.S. Pat. No. 4,433,048.

In this spectral sensitization performed by adding a sensitizing dye during or before chemical sensitization, the sensitivity/graininess ratio greatly improves when the amount of sensitizing dye to be added is 50% or more, preferably 60% or more of the saturated covering ratio of silver halide photographic emulsion grains. This is described in Jpn. Pat. Application No. 5-145355, whose Jpn. Pat. Appln. KOKAI Publication number (hereinafter referred to as JP-A) is 6-332091.

When a particularly large amount of a sensitizing dye is used, however, the sensitivity/graininess ratio is improved and at the same time the photographic properties degrade due to aggregation of emulsion grains, as disclosed in JP-A-6-332091. Silver halide emulsion grains aggregate especially in a tabular silver halide photographic emulsion in which tabular grains having an aspect ratio of 3 or more account for 50% or more of the total projected area. It is considered that this aggregation of silver halide emulsion grains takes place because a sensitizing dye adsorbed at a high covering ratio makes gelatin lose its protective colloidal properties for the silver halide emulsion grains. When aggregation occurs, the photographic properties degrade, e.g., the sensitivity lowers, the fog rises, and the graininess degrades. Additionally, coarse grains makes the manufacture difficult to perform. Accordingly, it is being strongly desired to solve this problem of aggregation.

JP-A-6-332091 has disclosed that addition of a silver iodobromide fine grain emulsion can solve the problem of aggregation of tabular silver halide grains when a large amount of a sensitizing dye is added. However, the aggregation inhibiting effect of calcium or magnesium in an emulsion is entirely unknown.

EP 590,725 has disclosed a method of manufacturing an emulsion in the presence of a water-soluble metal salt such as calcium nitrate or magnesium sulfate. However, although the solution concentration when the metal salt is added is described, the metal salt content in an emulsion is not specifically described. Also, the saturated covering ratio of sensitizing dye is not described. Additionally, EP 590,725 does not refer to aggregation of tabular silver halide grains which is a problem when a large amount of a sensitizing dye is added. Therefore, EP 590,725 is evidently different from the present invention.

JP-A-3-174142 has disclosed a method of manufacturing a high-speed silver halide sensitive material having high storage stability with time obtained by adjusting the calcium content of gelatin in the material. However, although the content in gelatin is specifically described, the content in an emulsion is not described. Also, aggregation of a tabular silver halide emulsion is not referred to. Furthermore, JP-A-8-272021 describes the calcium concentration of coating solution containing tabular grains. However, calcium is added to the solution to be coated. That is, JP-A-8-272021 does not describe any addition during the course of manufacture of a spectrally sensitized tabular silver halide emulsion.

That is, no method is known which uses calcium or magnesium to eliminate aggregation of tabular silver halide grains which is a problem when a large amount of a sensitizing dye is added.

BRIEF SUMMARY OF THE INVENTION

It is an object of the present invention to provide a tabular silver halide photographic emulsion manufacturing method which has solved the problem of aggregation of silver halide grains occurring when spectral sensitization is performed to improve the sensitivity/graininess ratio by adding a large amount of a sensitizing dye.

Other objects of the present invention will be apparent from the following description.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
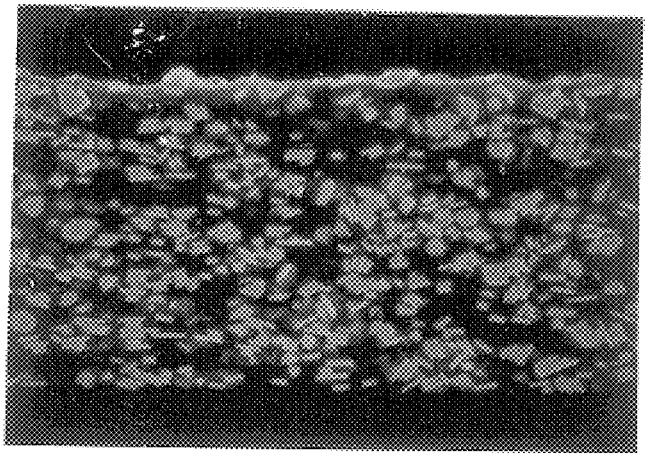
FIG. 1 is a sectional electron micrograph of a coated sample showing the structure of grains of an emulsion EM-4 prepared in an example of the present invention.

The present inventors have found that in a method for manufacturing a tabular silver halide photographic emulsion by performing spectral sensitization by adding a cyanine dye, aggregation of tabular silver halide photographic emulsion grains is greatly inhibited by adjusting the content of calcium ions or magnesium ions in the emulsion to 400 to 2,500 ppm or 50 to 2,500 ppm, respectively. It is described in "Journal of Imaging Science", Vol. 31, pp. 130 to 135 that calcium ions are adsorbed to silver halide grains in the presence of a certain kind of anionic sensitizing dye. However, it is unknown that the protective colloidal properties improve and the amount of gelation adsorbed to emulsion grains increases by calcium ions.

The present inventors have found that calcium or magnesium in an emulsion increases the amount of gelatin adsorbed to tabular silver halide grains and adsorption of calcium or magnesium itself to silver halide grains is promoted in the presence of a sensitizing dye. The present inventors estimate that calcium or magnesium so interacts as to intermediate between a sensitizing dye and gelatin on silver halide grain surfaces, thereby improving the protective colloidal properties for tabular silver halide grains.

The present inventors have found that the following means can eliminate aggregation of silver halide grains which is a problem when spectral sensitization is performed to improve the sensitivity/graininess ratio by adding a large amount of a cyanine dye.

(1) A method for producing a silver halide photographic emulsion comprising a step of spectrally sensitizing a silver halide photographic emulsion material, wherein an emulsion material contains tabular silver halide grains having an aspect ratio of 3 or 3 or more in an amount of 50% or more of the total projected area of all the silver halide grains in the emulsion material; the spectral sensitization is performed by adding a cyanine dye in an amount of 60% or more of the saturated covering amount of the silver halide grains; and the emulsion is produced in the presence of 400 to 2,500 ppm of calcium ions and/or 50 to 2,500 ppm of magnesium ions.

(2) A silver halide emulsion containing silver halide grains, wherein the silver halide grains are produced by adding a calcium salt and/or a magnesium salt in an effective amount to inhibit aggregation of the silver halide grains.

(3) A method for inhibiting aggregation of silver halide photographic emulsion comprising spectrally sensitizing a silver halide emulsion material, wherein the emulsion material contains tabular silver halide grains having an aspect ratio of 3 or more in an amount of 50% or more of the total projected area of all the grains in the emulsion material; the spectral sensitization is preformed by adding a cyanine dye in an amount of 60% or more of the saturated covering amount of the silver halide grains; and a calcium salt and/or a magnesium salt is added to the emulsion material such that a calcium ion content and/or a magnesium ion content during the spectral sensitization is 400 to 2,500 ppm and/or 50 to 2,500 ppm, respectively.

The present invention will be described in detail below.

The cyanine sensitizing dye used in spectral sensitization of a silver halide emulsion of the present invention can be added in any step of the emulsion production process. However, the cyanine dye is preferably added and spectrally sensitized during or before chemical sensitization. The dye represented by formula (I) below are practical examples of the cyanine dye useful in the present invention.

(I)

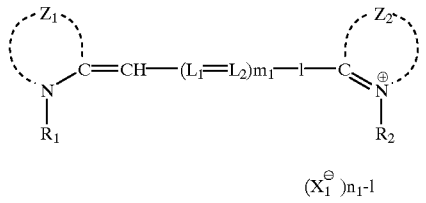

In formula (I), each of $Z_1$ and $Z_2$ independently represents a heterocyclic nucleus commonly used in a cyanine dye, particularly, an atomic group required to complete thiazole, thiazoline, benzothiazole, naphthothiazole, oxazole, oxazoline, benzoxazole, naphthoxazole, tetrazole, pyridine, quinoline, imidazoline, imidazole, benzoimidazole, naphthoimidazole, selenazoline, selenazole, benzoselenazole, naphthoselenazole, or indolenine. These nuclei can be substituted by a 1- to 4-carbon alkyl group such as methyl, a halogen atom, a phenyl group, a hydroxyl group, a 1- to 4-carbon alkoxy group, a carboxyl group, an alkoxycarbonyl group, an alkylsulfamoyl group, an alkylcarbamoyl group, an acetyl group, an acetoxy group, a cyano group, a trichloromethyl group, a trifluoromethyl group, or a nitro group.

Each of $L_1$ and $L_2$ independently represents a methine group or a substituted methine group. Examples of the substituted methine group are a methine group substituted by a lower alkyl group such as methyl or ethyl, phenyl, substituted phenyl, methoxy or ethoxy.

Each of $R_1$ and $R_2$ represents a 1- to 5-carbon alkyl group; a substituted alkyl group having a carboxy group; a substituted alkyl group having a sulfo group, e.g., β-sulfoethyl, γ-sulfopropyl, δ-sulfobutyl, γ-sulfobutyl, 2-(3-sulfopropoxy)ethyl, 2-[2-(3-sulfopropoxy)ethoxy]ethyl, and 2-hydroxy sulfopropyl; an allyl group; or a substituted alkyl group commonly used as an N-substituted group of a cyanine dye. $m_1$ represents 1, 2, or 3. $X_1^-$ represents iodine ion, bromine ion, or an acid anion group commonly used in a cyanine dye, e.g., p-toluenesulfonic acid ion, or perchloric acid ion. $n_1$ represents 1 or 2. When a cyanine dye takes a betaine structure, $n_1$ is 1.

The effect of the present invention is particularly notable when a trimethine cyanine dye in which $m_1$ is 2 is used.

Representative compounds of effective spectral sensitizing dyes used in the present invention are shown below.

I-1
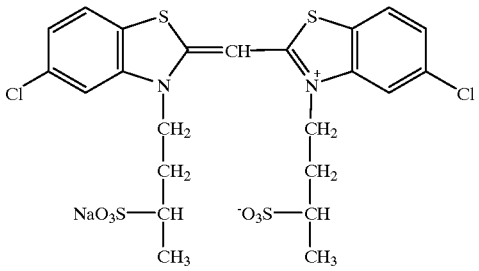
I-2
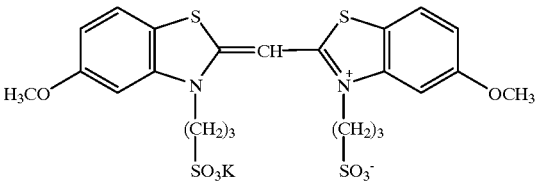
I-3
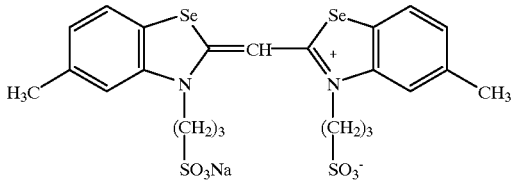
I-4
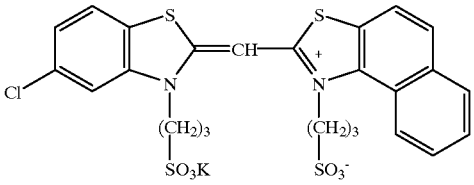
I-5
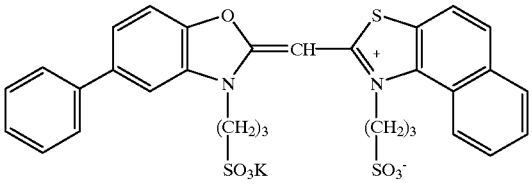
I-6
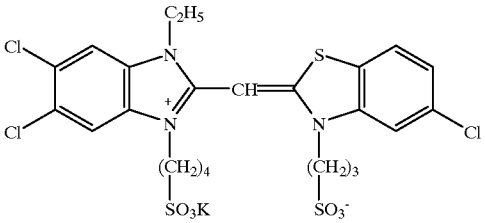
I-7
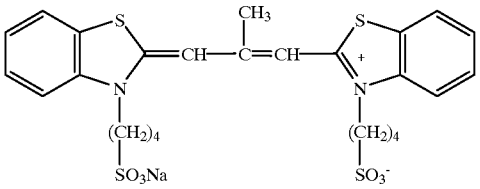
I-8
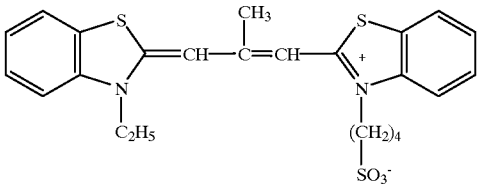
I-9
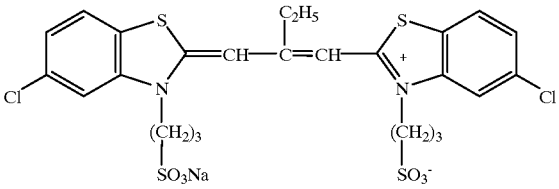
I-10
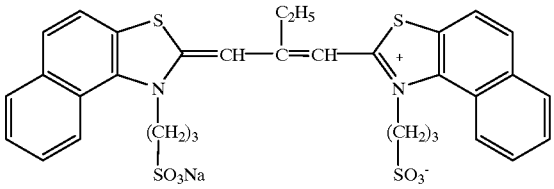
I-11
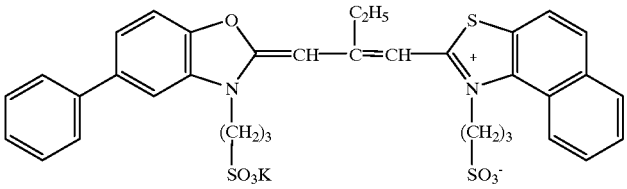
I-12
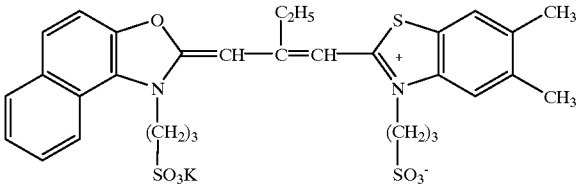

-continued
I-13
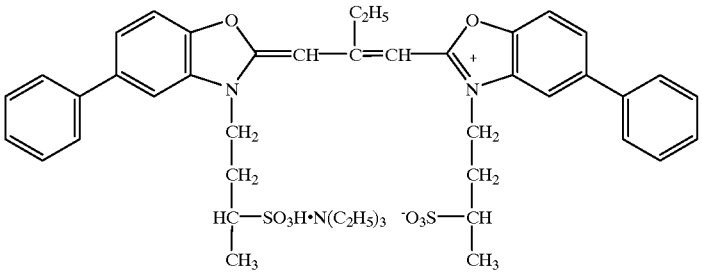
I-14
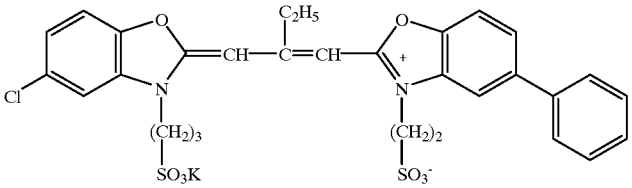
I-15
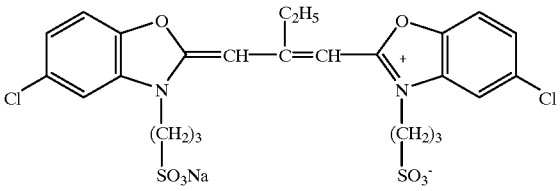
I-16
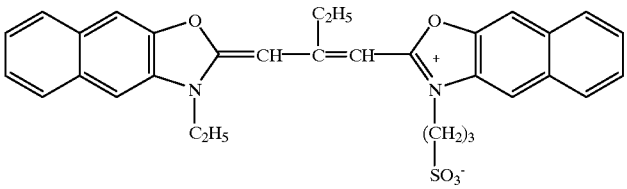
I-17
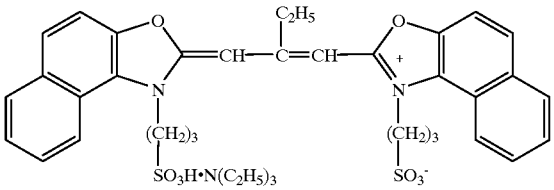
I-18
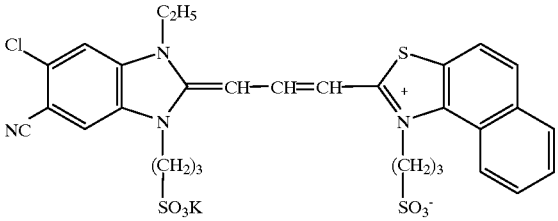
I-19
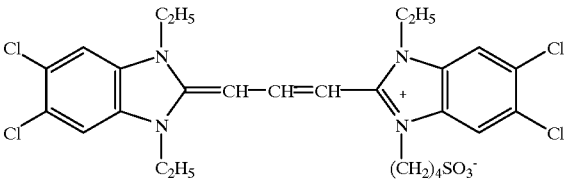
I-20
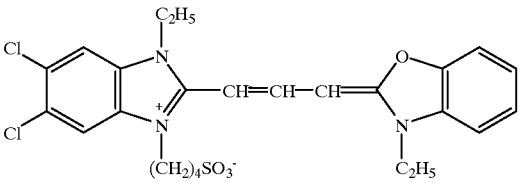
I-21
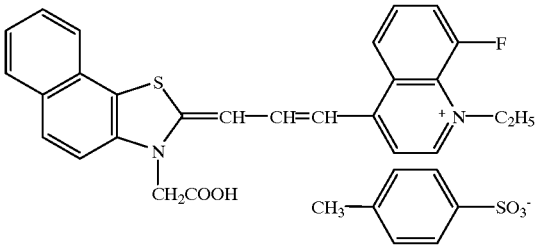
I-22
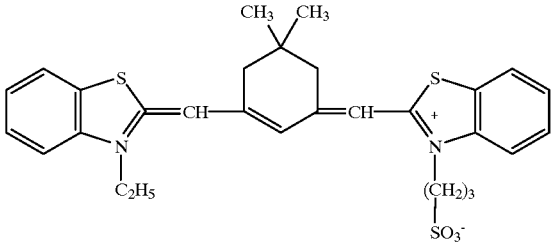

-continued
I-23
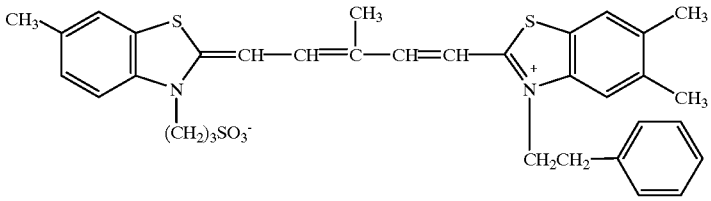
I-24
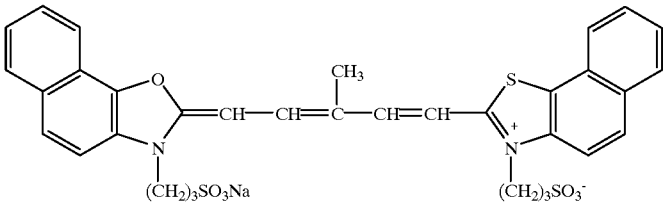
I-25
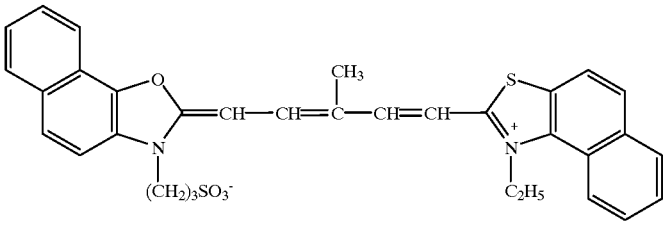
I-26
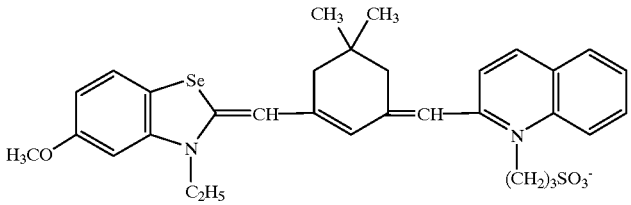
I-27
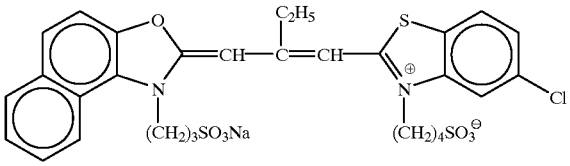
I-28
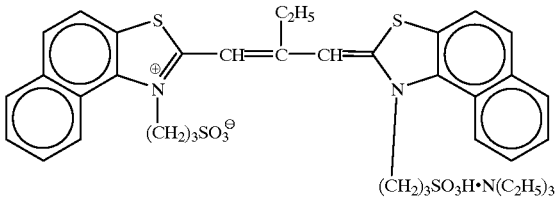
I-29
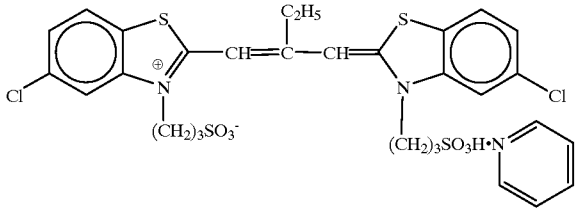
I-30
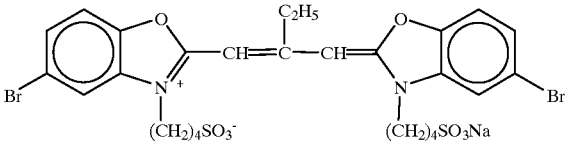
I-31
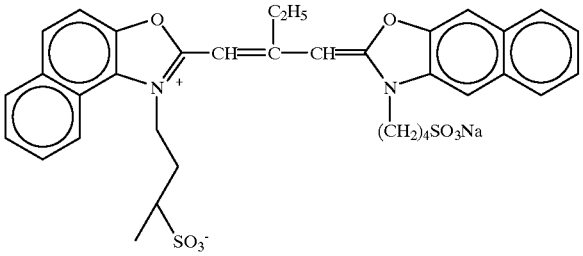
I-32
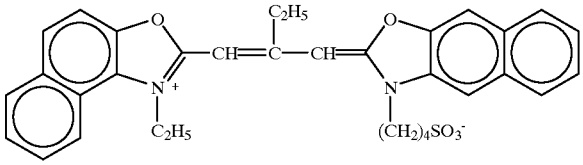

-continued

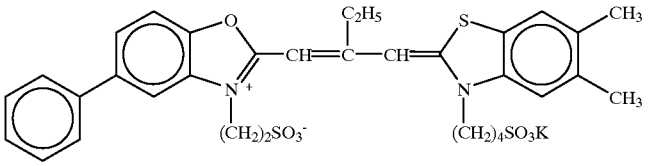

I-33

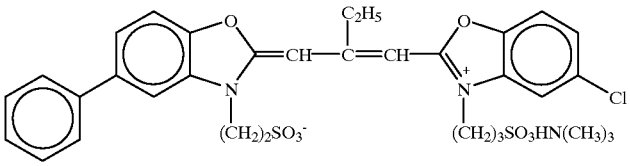

I-34

In addition to the above compounds, it is possible to use spectral sensitizing dyes described in, e.g., German Patent No. 929,080, U.S. Pat. Nos. 2,493,748, 2,503,776, 2,519,001, 2,912,329, 3,656,956, 3,672,897, 3,694,217, 4,025,349, 4,046,572, 2,688,545, 2,977,229, 3,397,060, 3,552,052, 3,527,641, 3,617,293, 3,628,964, 3,666,480, 3,672,898, 3,679,428, 3,703,377, 3,814,609, 3,837,862, and 4,026,344, British Patent Nos. 1,242,588, 1,344,281, and 1,507,803, Jpn. Pat. Appln. KOKOKU Publication No. (hereafter referred to as JP-B-) 44-14030, JP-B-52-24844, JP-B-43-4936, JP-B-53-12375, JP-A-52-110618, JP-A-52-109925, and JP-A-50-80827, all the disclosures of which are herein incorporated by reference.

The amount of the sensitizing dye added during the preparation of a silver halide emulsion depends upon the types of additive and silver halide used. However, the sensitizing dye addition amount is preferably 0.001 to 100 mmol, and more preferably 0.1 to 10 mmol per mol of silver halide.

In the present invention, the sensitizing dye addition amount is most preferably 60% or more, and more specifically 75% to 100% of the saturated covering amount of silver halide emulsion grains. As described in JP-A-5-145355, high sensitivity can be obtained when the addition amount of sensitizing dye is large and no aggregation of grains occurs. The saturated covering amount of sensitizing dye with respect to silver halide emulsion grains can be easily obtained by calculating a common sensitizing dye adsorption isotherm. The sensitizing dye adsorption isotherm is described in, e.g., T. H. James, "THE THEORY OF THE PHOTOGRAPHIC PROCESS, 4th ed., Macmillan (1977)", page 237, the disclosure of which is herein incorporated by reference. That is, it is generally possible to calculate the amount of adsorbed sensitizing dye by separating a solid phase from a liquid phase by centrifugal precipitation and measuring the difference between an initially added sensitizing dye and a sensitizing dye in the supernatant solution.

The cyanine dye as a sensitizing dye is preferably added during or before chemical sensitization. "During chemical sensitization" means a period from a timing immediately after a chemical sensitizer is added to a timing before the chemical sensitization is essentially complete. "Before chemical sensitization" means a period before a chemical sensitizer is added. More specifically, this period includes during grain formation, during physical ripening, during washing, during dispersion, and the period from the termination of dispersion to the initiation of the addition of a chemical sensitizer.

The sensitizing dye can be added by any arbitrary method. For example, a sensitizing dye can be added by dissolving it into water or an organic solvent such as alcohols, glycols, ketones, esters, or amides. It is also possible to use any of the following methods. That is, the dye is dispersed into water with the aid of a dispersant (surfactant), and the resultant solution is added, or, the solution is dried, and the resultant powder is added. The dye and a dispersant are formed into a homogeneous mixture (e.g., a gel, paste, or slurry) together with a binder such as gelatin, and the mixture is added, or, the mixture is dried, and the resultant powder is added. The dye is dispersed into water by milling it into fine grains of 1 $\mu$m or less without using any dispersant (or using a binder such as gelatin), and the resultant dispersion is added. During the addition of the sensitizing dye, the temperature is preferably 40° C. to 80° C., and more preferably 50° C. to 70° C.

In addition to the sensitizing dye, the emulsion of the invention can contain a dye having no spectral sensitizing effect or a substance not essentially absorbing visible light and presenting supersensitization. Examples are an aminostyryl compound substituted by a nitrogen-containing heterocyclic group (e.g., compounds described in U.S. Pat. Nos. 2,933,390 and 3,635,721), an aromatic organic acid formaldehyde condensation product (e.g., a product described in U.S. Pat. No. 3,743,510), cadmium salt, and an azaindene compound, all the disclosures of which are herein incorporated by reference. Combinations described in U.S. Pat. Nos. 3,615,613, 3,615,641, 3,617,295, and 3,635,721 are particularly useful, all the disclosures of which are herein incorporated by reference.

In the emulsion of the present invention, tabular silver halide grains having an aspect ratio of 3 or more account for 50% or more of the sum of the projected areas of all the grains.

The "tabular silver halide grain" is a general term of grains having one twin plane or two or more parallel twin planes. A "twin plane" is a (111) plane on both sides of which all ions at lattice points have a mirror image relationship to each other. This tabular silver halide grain is composed of two parallel major surfaces and side surfaces connecting these major surfaces. When this tabular grain is viewed in a direction perpendicular to its major surfaces, it looks like a triangle, a hexagon, or a circular triangle or hexagon. These triangular, hexagonal, and circular grains have parallel triangular, hexagonal, and circular major surfaces, respectively.

The present invention is more effective when tabular silver halide grains accounting for 50% or more of the sum of the projected areas of all the grains have an aspect ratio of more preferably 4 or more, and much more preferably 5 or more. The present invention is effective when the aspect ratio of grains accounting for 50% or more of the sum of the projected areas of all the grains is 50 or less. A tabular grain having a large aspect ratio has a large surface area/volume ratio and also has large smooth major surfaces. These grains readily aggregate by a sensitizing dye.

In the present invention, the aspect ratio of tabular silver halide grain is the value obtained by dividing the grain diameter by the grain thickness. The thickness of grain can be easily measured by obliquely depositing a metal together with a latex as a reference on the grain, measuring the length of the shadow of the latex on an electron micrograph, and calculating by referring to the length of the shadow of the latex.

In the present invention, a grain diameter (hereinafter also referred to as "an equivalent-circle diameter") is the diameter of circle having the same area as the projected area of the parallel major surfaces of a grain.

The projected area of grain can be obtained by measuring the area on an electron micrograph and correcting the magnification.

The average equivalent-circle diameter and average thickness of tabular silver halide grains are preferably 0.15 to 5.0 $\mu$m and 0.05 to 1.0 $\mu$m, respectively. The average equivalent-circle diameter is the average value of the equivalent-circle diameters of 1,000 or more grains randomly sampled from an even emulsion. The average thickness is the average value of the same kind. The average equivalent-sphere diameter is preferably 0.1 to 2.0 $\mu$m. The highest sensitivity/graininess ratio of photographic emulsion can be obtained within these ranges.

In an emulsion of the present invention, tabular silver halide grains having an aspect ratio of 3 or more account for preferably 80% or more.

More preferably, a hexagonal tabular silver halide, in which the ratio of an edge having the maximum length with respect to the length of an edge having the minimum length is 2 or less, and which has two parallel faces as major surfaces, accounts for 70% or more of the total projected area of all the silver halide grains. In addition, these hexagonal tabular silver halide grains have monodispersibility; that is, the variation coefficient of the grain size distribution of the grains (i.e., the value obtained by dividing a variation (standard deviation) in grain sizes, which are represented by the equivalent-circle diameters of the projected areas of the grains, by their average grain size) is 30% or less. Also, the grains have an average aspect ratio of 3 or more and a grain diameter of 0.2 to 2 $\mu$m.

An emulsion of the present invention is preferably a negative tabular silver halide photograph emulsion. This is because the effect of increasing the sensitivity by performing spectral sensitization by adding a cyanine dye during or before chemical sensitization is large in a negative tabular silver halide photographic emulsion. "Negative" means that blackening or coloring density increases as the exposure amount increases.

The halogen composition of silver halide grains contained in the photographic emulsion of the present invention can be any of silver bromide, silver iodobromide, silver iodochlorobromide, silver chlorobromide, silver chloride, and silver iodochloride. The halogen composition is preferably silver bromide, silver iodobromide, silver chlorobromide, or silver iodochlorobromide, and more preferably silver iodobromide. The average silver iodide content is preferably 3 to 10 mol %.

The silver halide grain of the present invention can have either a layered structure including at least two layers having essentially different halogen compositions inside the grain or a uniform composition.

The emulsion having a layered structure with different halogen compositions can be a silver iodobromide or silver chloroiodobromide emulsion containing a high-silver iodide phase in the core and a low-silver iodide layer in the outermost layer (shell), or containing a low-silver iodide phase in the core and a high-silver iodide layer in the outermost layer. The emulsion can also be a silver chloroiodobromide or silver chlorobromide emulsion containing a high-silver chloride phase in the core and a low-silver chloride layer in the outermost layer, or containing a low-silver chloride phase in the core and a high-silver chloride layer in the outermost layer. This layered structure can also include three or more layers.

In the process of grain formation or physical ripening of the tabular silver halide emulsion of the present invention, it is possible to coexist, e.g., cadmium salt, zinc salt, thallium salt, iridium salt or its complex salt, rhodium salt or its complex salt, or iron salt or its complex salt, with the grains.

In the manufacture of tabular silver halide grains of the present invention, it is possible to control the grain size, grain shape (e.g., diameter/thickness ratio), grain size distribution, and grain growth rate by using a silver halide solvent where necessary. The use amount of this solvent is $10^{-3}$ to 1.0 wt %, and preferably $10^{-2}$ to $10^{-1}$ wt % of the reaction solution.

For example, as the solvent use amount increases, it is possible to make the grain size distribution monodisperse and increase the growth rate. On the other hand, the grain thickness tends to increase with increasing solvent use amount.

Examples of often used silver halide solvents are ammonia, rhodan, thioether, and thioureas. Thioether is described in, e.g., U.S. Pat. Nos. 3,271,157, 3,790,387, and 3,574,628, the disclosures of which are herein incorporated by reference. Rhodan is preferably used.

The emulsion of the present invention is preferably sensitized by a sensitizer or sensitizers selected from selenium, gold, and sulfur sensitizers. As these selenium, gold, and sulfur sensitizers, compounds and addition amounts described in JP-A-δ-214336, the disclosure of which is herein incorporated by reference, can be preferably used. It is more preferable to combine these three types of sensitizers.

In the present invention, chemical sensitization can be more effectively performed in the presence of a silver halide solvent.

Examples of the silver halide solvent particularly usable when chemical sensitization is performed in the present invention are (a) organic thioethers described in U.S. Pat. Nos. 3,271,157, 3,531,289, and 3,574,628, JP-A-54-1019, and JP-A-54-158917, (b) thiourea derivatives described in JP-A-53-82408, JP-A-55-77737, and JP-A-55-2982, (c) silver halide solvents having a thiocarbonyl group sandwiched between an oxygen or sulfur atom and a nitrogen atom described in JP-A-53-144319, (d) imidazoles described in JP-A-54-100717, (e) sulfite, (f) ammonia, and (g) thiocyanate, all the disclosures of which are herein incorporated by reference.

Particularly preferable solvents are thiocyanate and tetramethylthiourea. Although the amount of solvent used changes in accordance with the type of the solvent, a preferable amount of, e.g., thiocyanate is $1\times10^{-4}$ to $1\times10^{-2}$ mol per mol of a silver halide.

Photographic emulsions manufactured by the method of the present invention can contain various compounds in order to prevent fog during the manufacturing process, storage, or photographic processing of a sensitive material, or to stabilize photographic properties. That is, a large number of compounds known as an antifoggant or a stabilizer can be added. Examples are azoles, particularly those having a water-soluble group, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; and azaindenes such as triazaindenes, tetrazaindenes (particularly hydroxy-substituted(1,3,3a,7)tetrazaindenes), and pentazaindenes; benzenethiosulfonic acid, benzenesulfinic acid, and benzenesulfonic acid amide.

In the present invention, these antifoggants or stabilizers are particularly preferably added at the time of chemical sensitization is terminated.

The tabular silver halide emulsion of the present invention contains 400 to 2,500 ppm of calcium and/or 50 to 2,500 of magnesium. The contents of calcium and magnesium are more preferably 500 to 2,000 ppm and 200 to 2,000 ppm, respectively. "400 to 2,500 ppm of calcium and/or 50 to 2,500 ppm of magnesium" means that the concentration of at least one of calcium and magnesium falls within the defined range. If the content of calcium or magnesium is larger than this value, inorganic salt previously held by calcium salt, magnesium salt, or gelatin separates out to cause failure in the manufacture of a sensitive material.

The content of calcium is the concentration by weight of all calcium-containing compounds, in terms of calcium atom, contained in the emulsion, per weight of the emulsion. The calcium-containing compounds contained in the emulsion includes calcium ions and calcium salts that are exogenously added to the emulsion during the preparation thereof and calcium salts that has originally been held by the ingredients of the emulsion such as gelatin.

The content of magnesium is the concentration by weight of all magnesium-containing compounds, in terms of magnesium atom, contained in the emulsion, per weight of the emulsion. The magnesium-containing compounds contained in the emulsion includes magnesium ions and magnesium salts that are exogenously added to the emulsion during the preparation thereof and magnesium salts that has originally been held by the ingredients of the emulsion such as gelatin.

The calcium content in a tabular silver halide emulsion of the present invention can be adjusted by adding calcium salt when the emulsion is prepared. Gelatin generally used in the preparation of emulsions already contains 100 to 4,000 ppm of calcium in the form of solid gelatin. The calcium content can be adjusted by further adding calcium salt to the gelatin or by first desalting (decalcificating) the gelatin in accordance with a known method such as washing or ion exchange, if necessary, and then adding calcium salt.

As this calcium salt, any organic and inorganic salts of calcium which can release calcium ions in an emulsion can be used. However, calcium nitrate and calcium chloride are preferable, and calcium nitrate is most preferable.

Analogously, the magnesium content can be adjusted by adding magnesium salt when the emulsion is prepared. As this magnesium salt, an organic inorganic salts of magnesium which can release magnesium ions in an emulsion can be used. However, magnesium nitrate, magnesium sulfate, and magnesium chloride are preferable, and magnesium nitrate is most preferable.

ICP emission spectral analysis is an example of a method of determining calcium or magnesium.

Although the advantages of the invention can be attained in the case where at least one of the calcium and magnesium contents meet the limitations of the invention, it is preferable that at least calcium content meets the limitation of the invention, adding calcium is more preferable.

Calcium and/or magnesium can be added in any process during emulsion manufacture. However, calcium and/or magnesium is added preferably after a sensitizing dye is added, and more preferably after a sensitizing dye is added and before chemical sensitization is performed. Calcium salt and/or magnesium salt is preferably added in the form of an aqueous solution.

Gelatin is generally used as hydrophilic colloid used in the process of preparing the emulsion of the present invention. It is also possible to use a gelatin derivative, modified gelatin, or gelatin having a special molecular weight distribution as disclosed in JP-A-60-80838. Furthermore, a synthetic or natural polymer can be contained in gelatin. Examples of gelatin are lime-processed gelatin, acid-processed gelatin, enzyme-processed, and a hydrolyzed product of gelatin.

Inhibition of aggregation of tabular silver halide grains attained by the present invention is evaluated by observing the dispersibility of emulsion grains on a sectional electron micrograph of a coated layer comprising the grains. The coated layer used in evaluation was made by dissolving a tabular silver halide emulsion such that the coating silver amount was 18.5 g/m$^2$ as a silver amount, without adding any gelatin to gelatin previously contained in the emulsion, and stirring the emulsion at 40° C. for 30 min. The sectional photograph was taken at a magnification of ×3,000, and the number of aggregates of the tabular silver halide grains was counted. An aggregate is a state in which the major surfaces of three or more tabular grains adhere to each other. Inhibition of aggregation was evaluated by calculating the average number of aggregates per visual field from sectional photographs of three or more visual fields. If this number is reduced by 30% or more, aggregation is inhibited.

The amount of gelatin adsorbed to aggregation-inhibited tabular silver halide grains of the present invention is calculated as a relative change with respect to grains having insufficient calcium and/or magnesium concentration by a semiquantitative method as will be described below.

(Adsorbed gelatin semiquantitative method)

5 g of a tabular silver halide emulsion was heated and dissolved at 40° C. 50 milliliter (hereinafter referred to as "mL") of hot water were added, and the solution was centrifugally separated at 3,000 to 4,000 rpm for 30 min to precipitate grains. The precipitated grains were washed several times with 50 mL of 40° C. hot water and centrifugally precipitated. The resultant grains were washed once with each of methanol and acetone in this order and dried to form a powder. The IR absorption of the obtained powder was measured by an FT-IR spectrometer to calculate the area of absorption peak per weight in the amide absorption band (near 1,650 cm$^{-1}$) of gelatin. A relative change in the adsorbed gelatin amount was estimated by comparing the values before and after the inhibition of aggregation.

An increase in the adsorbed gelation amount of tabular grains of the present invention is preferably 10% or more, and more preferably 20% or more with respect to aggregated grains having insufficient calcium or magnesium concentration.

Silver halide photographic emulsions of the present invention can be preferably applied to negative color sensitive materials (i.e., color negative sensitive materials and color reversal sensitive materials) and black-and-white sensitive materials. Examples are color and black-and-white negative films for general purposes and motion pictures. Emulsions of the present invention are also applicable to black-and-white sensitive materials for X-ray films, printing films, and microfilms.

Techniques and inorganic and organic materials usable when emulsions of the present invention are applied to color photosensitive materials are described in the following portions of JP-A-3-161745, the disclosure of which is herein incorporated by reference.

| | | |
|---|---|---|
| 1. | Layer arrangements: | page 28, lower left column, line 1 to page 29, upper right column, line 7 |
| 2. | Silver halide emulsions: | page 29, upper right column, line 8 to page 30, upper right column, line 12 |
| 3. | Yellow couplers: | page 30, lower right column, lines 5 to 11 |
| 4. | Magenta couplers: | page 30, lower right column, line 12 to page 31, line 3 |
| 5. | Cyan couplers: | page 31, lower left column, lines 4 to 16 |
| 6. | Polymer couplers: | page 31, upper left column, line 17 to upper right column, line 1 |
| 7. | Functional couplers: | page 31, upper right column, line 2 to lower right column, line 5 |
| 8. | Antiseptic and mildewproofing agents: | page 32, upper right column, lines 10 to 17 |
| 9. | Formalin scavengers: | page 30, lower left column, lines 16 to 20 |
| 10. | Other additives: | page 35, lower right column, line 19 to page 36, upper left column, line 14, and page 30, upper right column, line 13 to lower left column, line 15 |
| 11. | Dispersion methods: | page 31, lower right column, line 8 to page 32, upper right column, line 9 |
| 12. | Supports: | page 32, lower left column, lines 4 to 6 |
| 13. | Thickness and physical properties of film: | page 32, lower left column, line 7 to lower right column, line 10 |
| 14. | Color development step: | page 32, lower right column, line 15 to page 33, lower right column, line 16 |
| 15. | Desilvering step: | page 32, lower right column, line 17 to page 35, upper left column, line 16 |
| 16. | Automatic processor: | page 35, lower left column, line 17 to upper right column, line 5 |
| 17. | Washing/stabilizing: | page 35, upper right column, line 6 to lower right column, line 15 |

EXAMPLES

The present invention will be described in more detail below by way of its examples, but the invention is not limited to these examples.

Example 1

(Manufacture of emulsion EM)

1,000 mL of an aqueous solution containing 6 g of gelatin (Ca content=3,600 ppm) having an average molecular weight of 10,000 and 4.5 g of KBr were stirred at 30° C., and an aqueous $AgNO_3$ (7.3 g) solution and an aqueous KBr (5.3 g) solution were added by the double-jet method. After gelatin was added, the temperature was raised to 70° C. The silver potential was adjusted to −30 mV with respect to the saturated calomel electrode, and an aqueous $AgNO_3$ (141.1 g) and an aqueous KBr (containing 12 mol % of KI) solution were added at accelerated flow rates by the double-jet method. During the addition, the silver potential was held at −30 mV with respect to the saturated calomel electrode. After the temperature was lowered to 40° C., the silver potential was adjusted to −10 mV with respect to the saturated calomel electrode. An aqueous silver nitrate solution ($AgNO_3$=4.2 g) and an aqueous KI solution (4.1 g) were added over 5 min, and the temperature was raised to 60° C. After the silver potential was adjusted to −60 mV with respect to the saturated calomel electrode, an aqueous silver nitrate solution ($AgNO_3$=60 g) and an aqueous KBr solution were added at accelerated flow rates over 12 min by the double-jet method. During the addition, the silver potential was held at −60 mV with respect to the saturated calomel electrode. The resultant material was cooled and desalted by a conventional flocculation method. Gelatin was added, and the pAg and pH were adjusted to 8.6 and 5.8, respectively, at 40° C. The resultant emulsion contained tabular grains having an average equivalent-circle diameter of 1.60 $\mu$m (variation coefficient=29%), an average thickness of 0.29 $\mu$m, and an average aspect ratio of 5.5. The emulsion was occupied by tabular grains having an aspect ratio of 4 or more in an amount of 50% of the total projected area.

(Preparation of emulsions EM-1 to EM-9)

The emulsion EM was held at 60° C., and a sensitizing dye I-34 was so added that a covering ratio (wt % with respect to the saturated covering amount) shown in Table 1 was obtained. After that, calcium nitrate was added such that a concentration shown in Table 1 was obtained. Additionally, chemical sensitization was optimally performed by adding $3.0\times10^{-3}$ mol/molAg of potassium thiocyanate, $1.5\times10^{-6}$ mol/molAg of a gold sensitizer, $5.3\times10^{-6}$ mol/molAg of a sulfur sensitizer, and $4.2\times10^{-6}$ mol/molAg of a selenium sensitizer. After the chemical sensitization was complete, $2\times10^{-4}$ mol/molAg of an antifoggant F-2 (to be presented later) was added.

TABLE 1

| | Emulsion | Addition amount of spectral sensitizing dye (covering ratio (%)) | Ca concentration (ppm) | Average number of aggregates | Relative sensitivity |
|---|---|---|---|---|---|
| Comparison | EM-1 | 50 | 240 | 5 | 100 |
| Comparison | EM-2 | 65 | 240 | 8 | 125 |
| Comparison | EM-3 | 83 | 240 | 41 | 113 |
| Comparison | EM-4 | 100 | 240 | 72 | 72 |
| Invention | EM-5 | 83 | 740 | 24 | 143 |
| Invention | EM-6 | 100 | 740 | 29 | 133 |
| Invention | EM-7 | 100 | 1500 | 7 | 188 |
| Comparison | EM-8 | 100 | 3300 | 4 | 188 |
| Invention | EM-9 | 100 | 460 | 34 | 127 |

Each of the resultant emulsions EM-1 to EM-9 was dissolved at 40° C., and cellulose triacetate film support having an undercoat layer was coated with each of these emulsions such that the coating amount was 18.5 g/m$^2$ as a silver amount. To improve the coating properties, an appropriate amount of a surfactant presented below was added.

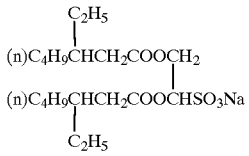

Three or more visual fields of sectional electron micrographs of each resultant coated sample were taken at a magnification of ×3,000, and the average number of aggregates per visual field was counted.

Figure 2:
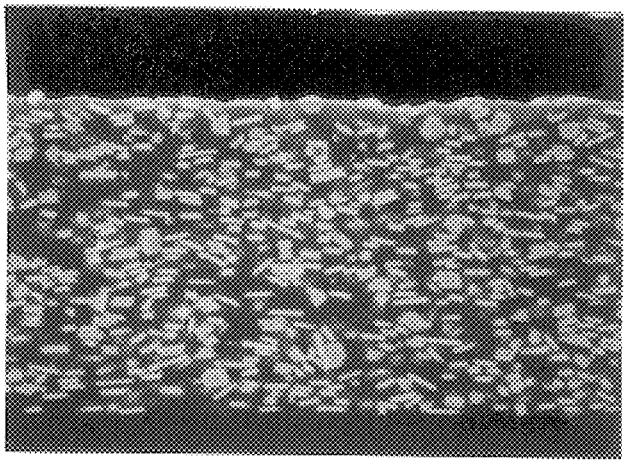
FIG. 2 is a sectional electron micrograph of a coated sample showing the structure of grains of an emulsion EM-6 prepared in an example of the present invention.
Figure 3:
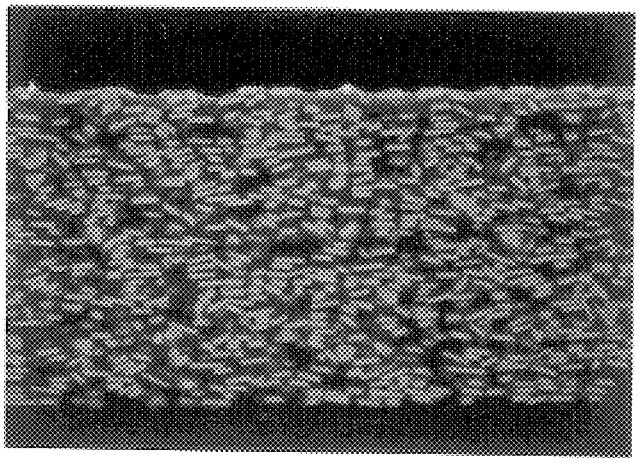
FIG. 3 is a sectional electron micrograph of a coated sample showing the structure of grains of an emulsion EM-7 prepared in an example of the present invention.

FIGS. 1 to 3 show the sectional electron micrographs of the emulsions EM-4, EM-6, and EM-7 shown in Table 1.

Evaluation of Sensitivity and Fog

Coating of the emulsions EM-1 to EM-9 was performed following the same procedure as in Example 1 of JP-A-5-145355, and development was also similarly performed. Note that the coating of the emulsions was performed immediately after they were dissolved. The density of each processed sample was measured through a green filter. The results are shown in Table 1 above.

As shown in Table 1, most grains of EM-4 aggregated to form apparently large grains. This aggregation of grains took place between the smooth surfaces of tabular grains. As shown in FIGS. 2 and 3, on the other hand, individual grains of EM-6 and EM-7 more and more separately aligned in the coating films as the calcium concentration increased. It is obvious that aggregation of grains caused by an increased amount of sensitizing dyes can be prevented by increasing the calcium concentration. In the emulsion EM-8 having a calcium concentration of 3,300 ppm, aggregation of grains was effectively prevented. However, this emulsion was not preferred because inorganic salt separated out during the manufacture.

Also, although aggregation was little in EM-1 and EM-2, improvements of the sensitivity were unsatisfactory for this dye addition amount.

Example 2

Emulsions EM-10 to EM-13 were prepared following the same procedure as for the emulsion EM-4 in Example 1 except that the magnesium concentration in each emulsion was adjusted by adding magnesium nitrate, instead of calcium nitrate. Aggregation of grains was evaluated following the same procedure as in Example 1. The results are shown in Table 2 below.

TABLE 2

| | Emulsion | Addition amount of spectral sensitizing dye (covering ratio (%)) | Mg concentration (ppm) | Average number of aggregates |
|---|---|---|---|---|
| Comparison | EM-4 | 100 | 9 | 72 |
| Invention | EM-10 | 100 | 170 | 32 |
| Invention | EM-11 | 100 | 420 | 22 |
| Invention | EM-12 | 100 | 1010 | 7 |
| Invention | EM-13 | 100 | 1500 | 3 |

Table 2 shows that a good aggregation preventing effect can also be obtained by increasing the magnesium concentration.

A magnesium concentration exceeding 2,000 ppm had a good effect on the prevention of aggregation as in Example 1. However, this concentration was not preferred because inorganic salt separated out during the manufacture.

Example 3

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec. The result was a 90-$\mu$m thick PEN film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hrs, manufacturing a support with a high resistance to curling.

2) Coating of Undercoat Layer

The two surfaces of the support were subjected to corona discharge, UV discharge, and glow discharge and coated with an undercoat solution (10 cc/m$^2$, by using a bar coater) consisting of 0.1 g/m$^2$ of gelatin, 0.01 g/m$^2$ of sodiumasulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, forming undercoat layers on sides at a high temperature upon orientation. Drying was performed at 115° C. for 6 min (all rollers and conveyors in the drying zone were at 115° C.).

3) Coating of Back Layers

On one surface of the undercoated support, an antistatic layer, a magnetic recording layer, and a slip layer having the following compositions were coated as back layers.

3-1) Coating of Antistatic Layer 0.2 g/m$^2$ of a dispersion (secondary aggregation grain size=about 0.08 $\mu$m) of a fine-grain powder, having a specific resistance of 5 Ω·cm, of a tin oxide-antimony oxide composite material with an average grain size of 0.005 $\mu$m was coated together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and 0.22 g/m$^2$ of resorcin.

3-2) Coating of Magnetic Recording Layer 0.06 g/m$^2$ of cobalt-γ-iron oxide (specific area 43 m$^2$/g, major axis 0.14 $\mu$m, minor axis 0.03 $\mu$m, saturation magnetization 89 emu/g, $Fe^{+2}/Fe^{+3}$=6/94, the surface was treated with 2 wt % of iron oxide by aluminum oxide silicon oxide) coated with 3-polyoxyethylene-propyloxytrimethoxysilane (polymerization degree 15, 15 wt %) was coated by a bar coater together with 1.2 g/m$^2$ of diacetylcellulose (iron oxide was dispersed by an open kneader and a sand mill) by using 0.3 g/m$^2$ of $C_2H_2C(CH_2OCONH{-}C_6H_3(CH_3)NCO)_3$ as a hardener and acetone, methylethylketone, and cyclohexane as solvents, forming a 1.2-$\mu$m thick magnetic recording layer. 10 mg/m$^2$ of silica grains (0.3 $\mu$m) were added as a matting agent, and 10 mg/m$^2$ of aluminum oxide (0.15 $\mu$m) coated with 3-polyoxyethylene-propyloxytrimethoxysilane (polymerization degree 15, 15 wt %) were added as a polishing agent. Drying was performed at 115° C. for 6 min (all rollers and conveyors in the drying zone were at 115° C.). The color density increase of DB of the magnetic recording layer measured by an X-light (blue filter) was about 0.1. The saturation magnetization moment, coercive force, and squareness ratio of the magnetic recording layer were 4.2 emu/g, 7.3×10$^4$ A/m, and 65%, respectively.

3-3) Preparation of Slip Layer

Diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$) were coated. Note that this mixture was melted in xylene/propylenemonomethylether (1/1) at 105° C., dispersed in propylenemonomethylether (tenfold amount), and formed into a dispersion (average grain size 0.01 $\mu$m) in acetone before being added. 15 mg/m$^2$ of silica grains (0.3 $\mu$m) were added as a matting agent, and 15 mg/m$^2$ of 3-polyoxyethylene-propyloxytrimethoxysiliane (polymerization degree 15, aluminum oxide coated by 15 wt %, 0.15 $\mu$m) were added as a polishing agent. Drying was performed at 115° C. for 6 min (all rollers and conveyors in the drying zone were at 115° C.). The resultant slip layer was found to have excellent characteristics. That is, the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

On the side away from the back layers formed as above, a plurality of layers having the following compositions were coated to manufacture a color negative film. This film will be referred to as a sample 301 hereinafter.

(Compositions of sensitive layers)

The main materials used in the individual layers are classified as follows.

| | |
|---|---|
| ExC: Cyan coupler | UV: Ultraviolet absorbent |
| ExM: Magenta coupler | HBS: High-boiling organic solvent |
| ExY: Yellow coupler | H: Gelatin hardener |
| ExS: Sensitizing dye | |

The number corresponding to each component indicates the coating amount in units of g/m$^2$. The coating amount of a silver halide is represented by the amount of silver. The coating amount of each sensitizing dye is represented in units of mols per mol of a silver halide in the same layer.

(Sample 301)

| | |
|---|---|
| 1st layer (1st antihalation layer) | |
| Black colloidal silver | silver 0.08 |
| Gelatin | 0.70 |
| 2nd layer (2nd antihalation layer) | |
| Black colloidal silver | silver 0.09 |
| Gelatin | 1.00 |
| ExM-1 | 0.12 |
| ExF-1 | $2.0 \times 10^{-3}$ |
| Solid disperse dye ExF-2 | 0.030 |
| Solid disperse dye ExF-3 | 0.040 |
| HBS-1 | 0.15 |
| HBS-2 | 0.02 |
| 3rd layer (Interlayer) | |
| ExC-2 | 0.05 |
| Polyethylacrylate latex | 0.20 |
| Gelatin | 0.70 |
| 4th layer (Low-speed red-sensitive emulsion layer) | |
| Silver iodobromide emulsion A-1 | silver 0.02 |
| Silver iodobromide emulsion B-1 | silver 0.23 |
| Silver iodobromide emulsion C-1 | silver 0.10 |
| ExS-1 | $3.8 \times 10^{-4}$ |
| ExS-2 | $1.6 \times 10^{-5}$ |
| ExS-3 | $5.2 \times 10^{-4}$ |
| ExC-1 | 0.17 |
| ExC-2 | 0.02 |
| ExC-3 | 0.040 |
| ExC-4 | 0.10 |
| ExC-5 | 0.020 |
| ExC-6 | 0.010 |
| Cpd-2 | 0.025 |
| HBS-1 | 0.15 |
| Gelatin | 1.10 |
| 5th layer (Medium-speed red-sensitive emulsion layer) | |
| Silver iodobromide emulsion C-1 | silver 0.15 |
| Silver iodobromide emulsion D-1 | silver 0.46 |
| ExS-1 | $4.0 \times 10^{-4}$ |
| ExS-2 | $2.1 \times 10^{-5}$ |
| ExS-3 | $5.7 \times 10^{-4}$ |
| ExC-1 | 0.14 |
| ExC-2 | 0.02 |
| ExC-3 | 0.03 |
| ExC-4 | 0.090 |
| ExC-5 | 0.02 |
| ExC-6 | 0.01 |
| Cpd-4 | 0.030 |
| Cpd-2 | 0.05 |
| HBS-1 | 0.15 |
| Gelatin | 0.75 |

-continued

6th layer (High-speed red-sensitive emulsion layer)

| | | |
|---|---|---|
| Silver iodobromide emulsion E-1 | silver | 1.30 |
| ExS-1 | | $2.5 \times 10^{-4}$ |
| ExS-2 | | $1.1 \times 10^{-5}$ |
| ExS-3 | | $3.6 \times 10^{-4}$ |
| ExC-1 | | 0.12 |
| ExC-3 | | 0.11 |
| ExC-6 | | 0.020 |
| ExC-7 | | 0.010 |
| Cpd-2 | | 0.050 |
| Cpd-4 | | 0.020 |
| HBS-1 | | 0.22 |
| HBS-2 | | 0.050 |
| Gelatin | | 1.40 |

7th layer (Interlayer)

| | |
|---|---|
| Cpd-1 | 0.060 |
| Solid disperse dye ExF-4 | 0.030 |
| HBS-1 | 0.040 |
| Polyethylacrylate latex | 0.15 |
| Gelatin | 1.10 |

8th layer (Low-speed green-sensitive emulsion layer)

| | | |
|---|---|---|
| Silver iodobromide emulsion F | silver | 0.22 |
| Silver iodobromide emulsion G | silver | 0.35 |
| ExS-7 | | $1.4 \times 10^{-4}$ |
| ExS-8 | | $6.2 \times 10^{-4}$ |
| ExS-4 | | $2.7 \times 10^{-5}$ |
| ExS-5 | | $7.0 \times 10^{-5}$ |
| ExS-6 | | $2.7 \times 10^{-4}$ |
| ExM-3 | | 0.410 |
| ExM-4 | | 0.086 |
| ExY-1 | | 0.070 |
| ExY-5 | | 0.0070 |
| HBS-1 | | 0.30 |
| HBS-3 | | 0.015 |
| Cpd-4 | | 0.010 |
| Gelatin | | 0.95 |

9th layer (Medium-speed green-sensitive emulsion layer)

| | | |
|---|---|---|
| Silver iodobromide emulsion G | silver | 0.48 |
| Silver iodobromide emulsion H | silver | 0.48 |
| ExS-4 | | $4.8 \times 10^{-5}$ |
| ExS-7 | | $2.1 \times 10^{-4}$ |
| ExS-8 | | $9.3 \times 10^{-4}$ |
| ExC-8 | | 0.0020 |
| ExM-3 | | 0.115 |
| ExM-4 | | 0.035 |
| ExM-5 | | 0.0050 |
| ExY-1 | | 0.010 |
| ExY-4 | | 0.010 |
| ExY-5 | | 0.0050 |
| Cpd-4 | | 0.011 |
| HBS-1 | | 0.13 |
| HBS-3 | | $4.4 \times 10^{-3}$ |
| Gelatin | | 0.80 |

10th layer (High-speed green-sensitive emulsion layer)

| | | |
|---|---|---|
| Silver iodobromide emulsion I | silver | 1.30 |
| ExS-4 | | $4.5 \times 10^{-5}$ |
| ExS-7 | | $1.2 \times 10^{-4}$ |
| ExS-8 | | $5.3 \times 10^{-4}$ |
| ExC-1 | | 0.021 |
| ExM-1 | | 0.010 |
| ExM-2 | | 0.030 |
| ExM-5 | | 0.0070 |
| ExM-6 | | 0.0050 |
| Cpd-3 | | 0.017 |
| Cpd-4 | | 0.040 |
| HBS-1 | | 0.25 |
| Polyethylacrylate latex | | 0.15 |
| Gelatin | | 1.33 |

11th layer (Yellow filter layer)

| | | |
|---|---|---|
| Yellow colloidal silver | silver | 0.015 |
| Cpd-1 | | 0.16 |
| Solid disperse dye ExF-5 | | 0.060 |
| Solid disperse dye ExF-6 | | 0.060 |

-continued

| | | |
|---|---|---|
| Oil-soluble dye ExF-7 | | 0.010 |
| HBS-1 | | 0.60 |
| Gelatin | | 0.60 |

12th layer (Low-speed blue-sensitive emulsion layer)

| | | |
|---|---|---|
| Silver iodobromide emulsion J | silver | 0.12 |
| Silver iodobromide emulsion K | silver | 0.15 |
| Silver iodobromide emulsion L | silver | 0.19 |
| ExS-9 | | $8.4 \times 10^{-4}$ |
| ExC-1 | | 0.03 |
| ExC-8 | | $7.0 \times 10^{-3}$ |
| ExY-1 | | 0.050 |
| ExY-2 | | 0.75 |
| ExY-3 | | 0.40 |
| ExY-4 | | 0.040 |
| Cpd-2 | | 0.10 |
| Cpd-4 | | 0.01 |
| Cpd-3 | | $4.0 \times 10^{-3}$ |
| HBS-1 | | 0.28 |
| Gelatin | | 2.10 |

13th layer (High-speed blue-sensitive emulsion layer)

| | | |
|---|---|---|
| Silver iodobromide emulsion M | silver | 0.58 |
| ExS-9 | | $3.5 \times 10^{-4}$ |
| ExY-2 | | 0.070 |
| ExY-3 | | 0.070 |
| ExY-4 | | 0.0050 |
| Cpd-2 | | 0.10 |
| Cpd-3 | | $1.0 \times 10^{-3}$ |
| Cpd-4 | | 0.02 |
| HBS-1 | | 0.075 |
| Gelatin | | 0.55 |

14th layer (1st protective layer)

| | | |
|---|---|---|
| Silver iodobromide emulsion N | silver | 0.10 |
| UV-1 | | 0.13 |
| UV-2 | | 0.10 |
| UV-3 | | 0.16 |
| UV-4 | | 0.025 |
| ExF-8 | | 0.001 |
| ExF-9 | | 0.002 |
| HBS-1 | | $5.0 \times 10^{-2}$ |
| HBS-4 | | $5.0 \times 10^{-2}$ |
| Gelatin | | 1.8 |

15th layer (2nd protective layer)

| | |
|---|---|
| H-1 | 0.40 |
| B-1 (diameter 1.7 $\mu$m) | 0.04 |
| B-2 (diameter 1.7 $\mu$m) | 0.09 |
| B-3 | 0.13 |
| S-1 | 0.20 |
| Gelatin | 0.70 |

In addition to the above components, to improve the storage stability, processability, resistance to pressure, antiseptic and mildewproofing properties, antistatic properties, and coating properties, the individual layers contained W-1 to W-3, B-4 to B-6, F-1 to F-18, iron salt, lead salt, gold salt, platinum salt, palladium salt, iridium salt, and rhodium salt.

Table 3 below shows the properties and the like of the emulsions used in this example.

TABLE 3

| Emulsion | Average AgI content (%) | Average grain size (Equivalent spherical diameter (μm)) | Variation coefficient of the grain size (%) | Diameter of projected area equivalent circular diameter (μm) | Diameter/ thickness | Tabularity |
|---|---|---|---|---|---|---|
| A-1 | 3.7 | 0.37 | 13 | 0.43 | 3.8 | 12 |
| B-1 | 3.7 | 0.43 | 19 | 0.58 | 3.2 | 18 |
| C-1 | 5.0 | 0.55 | 20 | 0.86 | 6.2 | 45 |
| D-1 | 5.4 | 0.66 | 23 | 1.10 | 7.0 | 45 |
| E-1 | 4.7 | 0.85 | 22 | 1.36 | 5.5 | 22 |
| F | 3.7 | 0.43 | 19 | 0.58 | 3.2 | 18 |
| G | 5.4 | 0.55 | 20 | 0.86 | 6.2 | 45 |
| H | 5.4 | 0.66 | 23 | 1.10 | 7.0 | 45 |
| I | 7.5 | 0.85 | 24 | 1.30 | 5.0 | 19 |
| J | 3.7 | 0.37 | 19 | 0.55 | 4.6 | 38 |
| K | 3.7 | 0.37 | 19 | 0.55 | 4.6 | 38 |
| L | 8.8 | 0.64 | 23 | 0.85 | 5.2 | 32 |
| M | 6.3 | 1.05 | 20 | 1.46 | 3.7 | 9 |
| N | 1.0 | 0.07 | — | — | 1.0 | — |

In Table 3, (1) The emulsions J to M were subjected to reduction sensitization during grain adjustment by using thiourea dioxide and thiosulfonic acid in accordance with embodiments in U.S. Pat. No. 5,061,614.

(2) The emulsions C-1 to I and M were subjected to gold sensitization, sulfur sensitization, and selenium sensitization in the presence of the spectral sensitizing dyes described in the individual sensitive layers and sodium thiocyanate in accordance with embodiments in EP 443,453A.

(3) The tabular grains were prepared by using low-molecular weight gelatin in accordance with embodiments in JP-A-1-158426.

(4) Dislocation lines as described in EP 443,453A were observed in the tabular grains when a high-voltage electron microscope was used.

(5) The emulsions A-1 to E-1, G, H, and J to M contained optimum amounts of Rh, Ir, and Fe.

Also, letting Dc be the average equivalent-circle diameter of the projected areas of tabular grains and t be the average thickness of the tabular grains, the flatness is defined by $Dc/t^2$.

Preparation of Dispersions of Organic Solid Disperse Dyes

ExF-2 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-2 and 500 mL of zirconium oxide beads (diameter 1 mm) were added to the mill. The contents were dispersed for 2 hours. This dispersion was done by using a BO type oscillating ball mill manufactured by Chuo Koki K. K. The dispersion was removed from the mill and added to 8 g of a 12.5% aqueous solution of gelatin. The beads were removed from the resultant material by filtration, obtaining a gelatin dispersion of the dye. The average grain size of the fine dye grains was 0.44 μm.

Following the same procedure as above, solid dispersions ExF-3, ExF-4, and ExF-6 were obtained. The average grain sizes of these fine dye grains were 0.24, 0.45, and 0.52 μm, respectively. ExF-5 was dispersed by a microprecipitation dispersion method described in Example 1 of EP549,489A. The average grain size was found to be 0.06 μm.

Formulas and the like of the compounds used in this example are presented below.

ExC-1

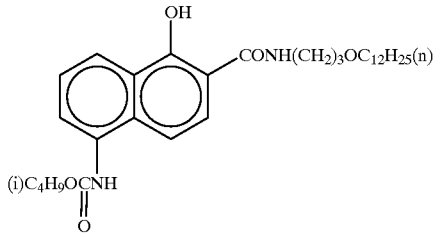

-continued
ExC-2
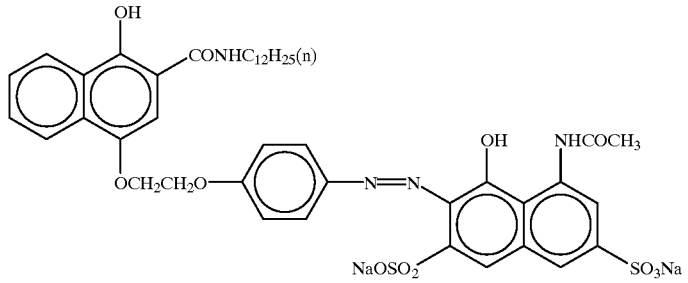
ExC-3
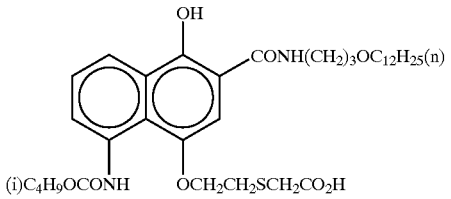
ExC-4
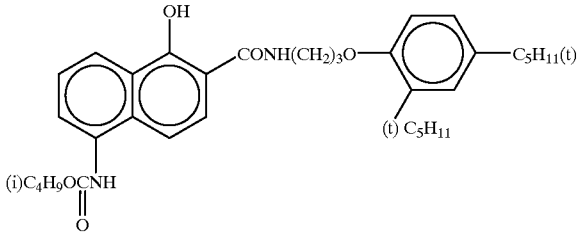
ExC-5
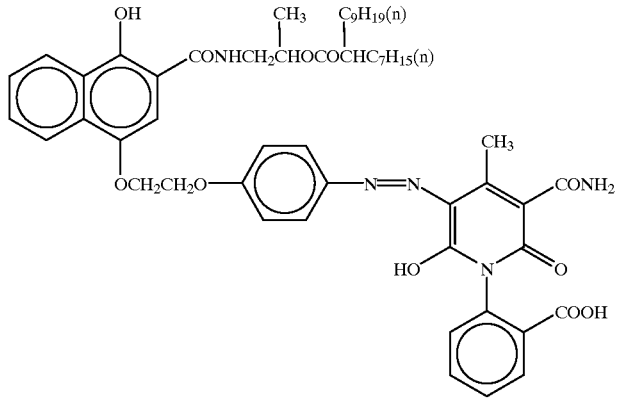
ExC-6
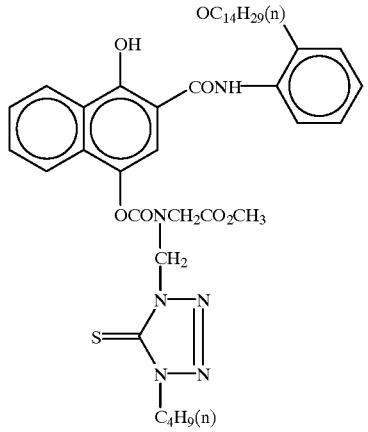

-continued
ExC-7
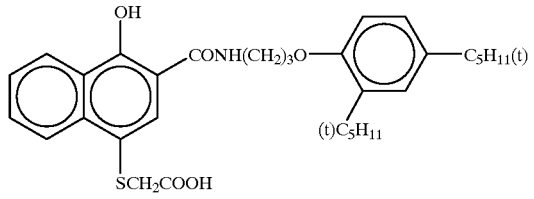
ExC-8
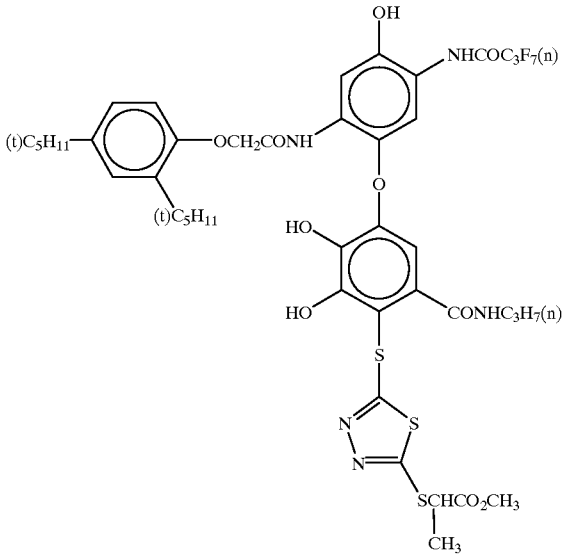
ExM-1
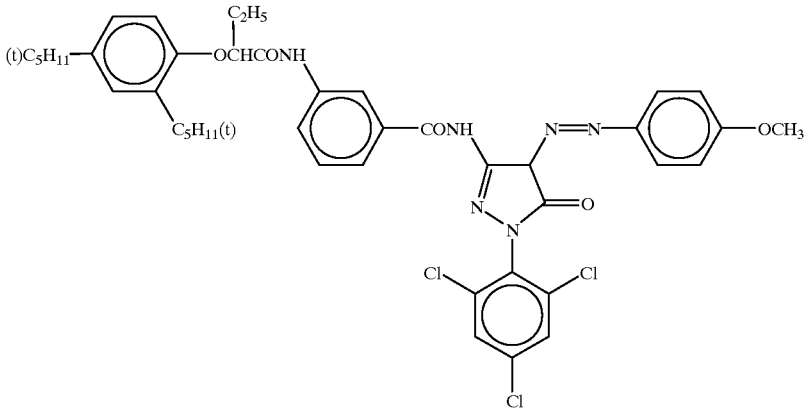
ExM-2
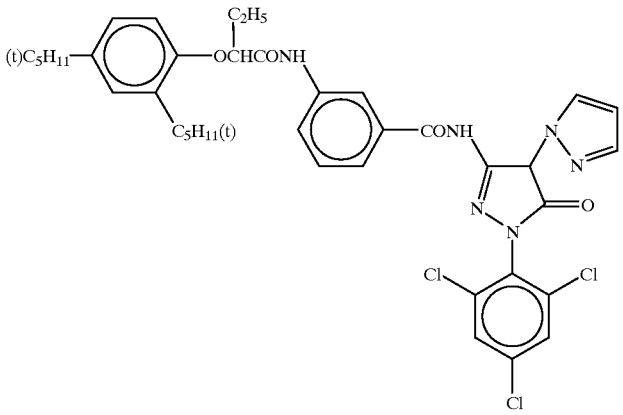

-continued
ExM-3
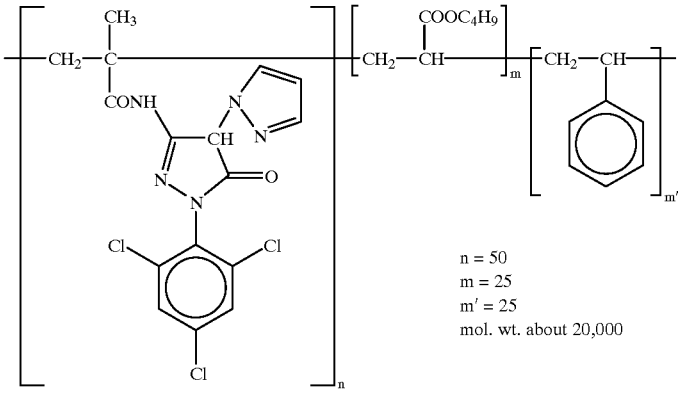
n = 50
m = 25
m' = 25
mol. wt. about 20,000
ExM-4
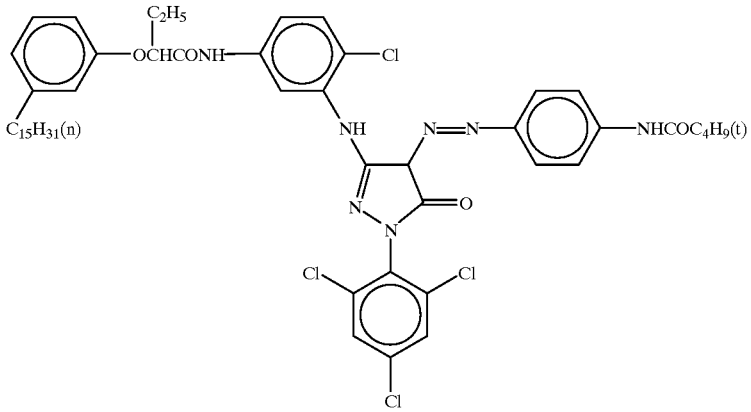
ExM-5
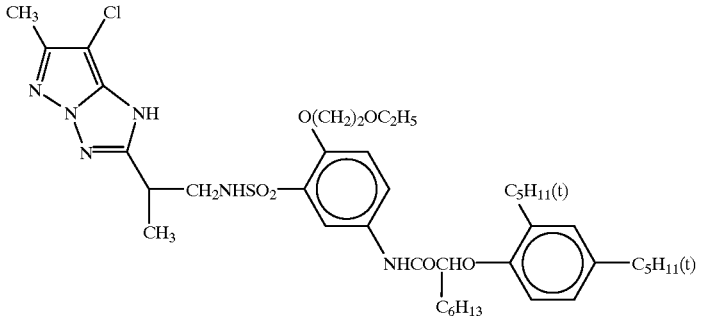
ExM-6
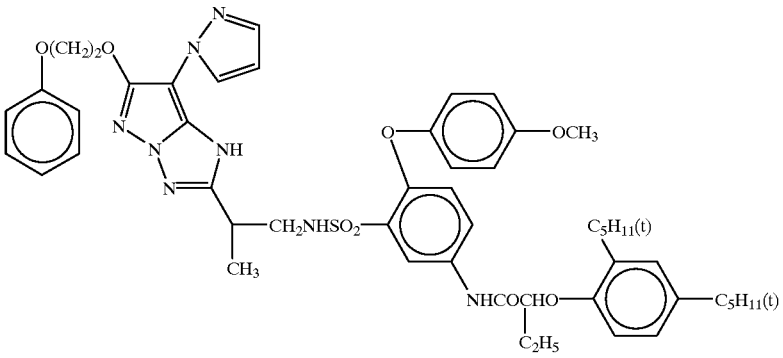

-continued
ExY-1
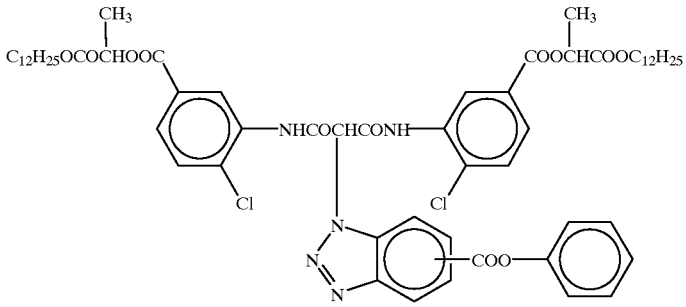
ExY-2
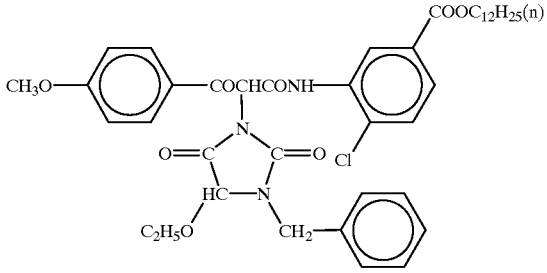
ExY-3
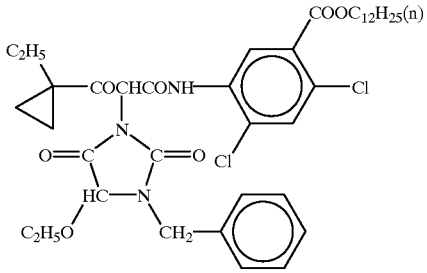
ExY-4
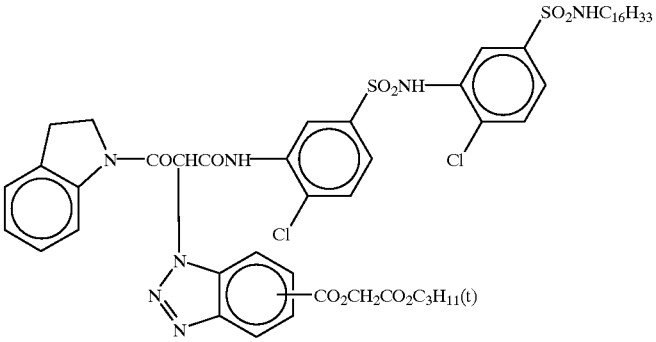
ExY-5
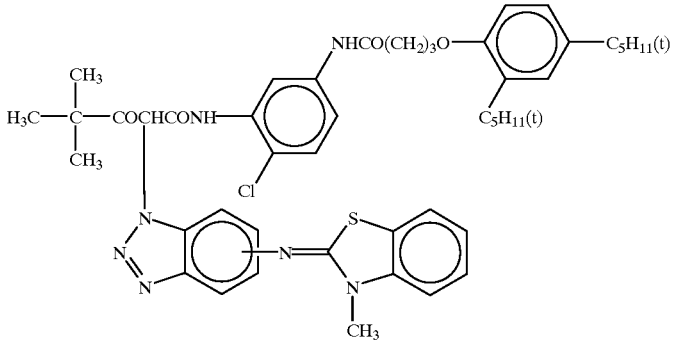

-continued
ExF-1
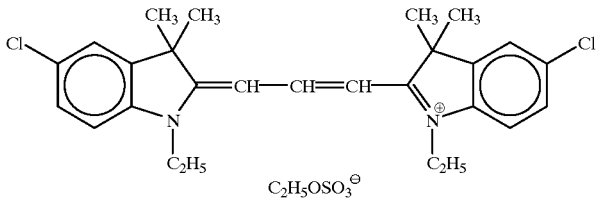
ExF-2
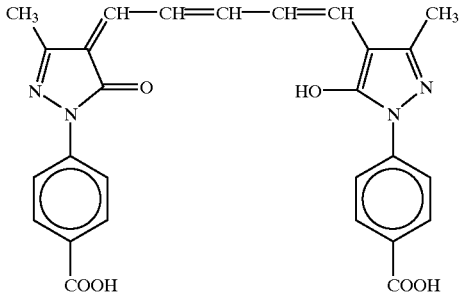
ExF-3
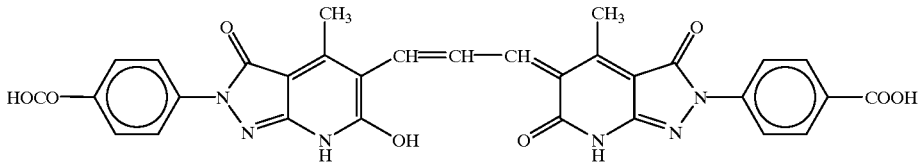
ExF-4
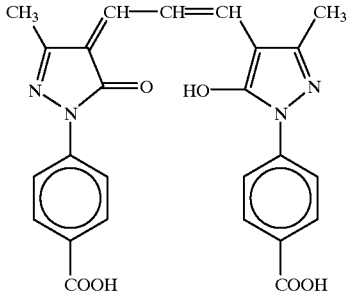
ExF-5
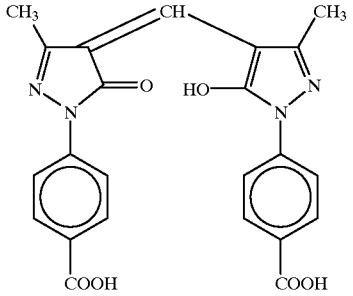
ExF-6
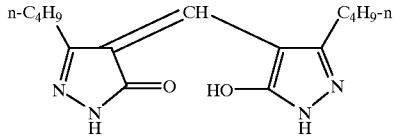

-continued
ExF-7
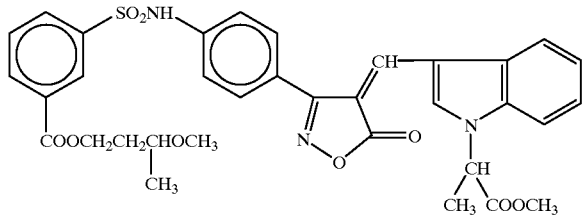
ExF-8
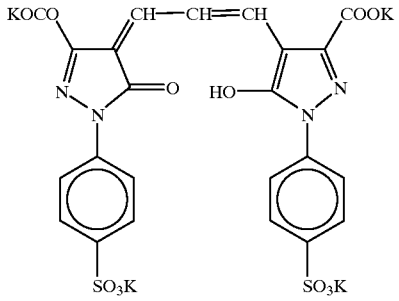
ExF-9
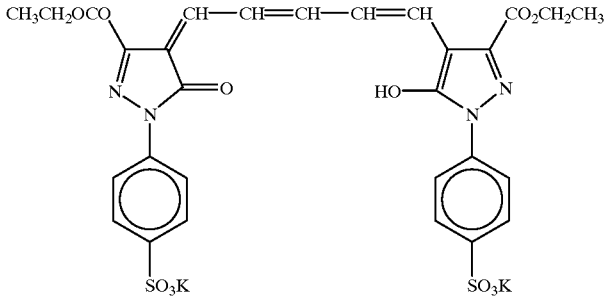
Cpd-1
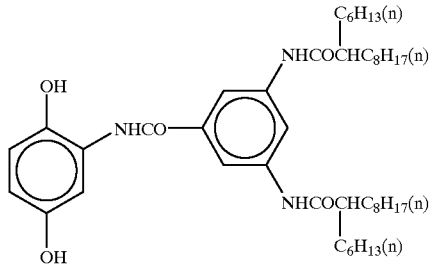
Cpd-2
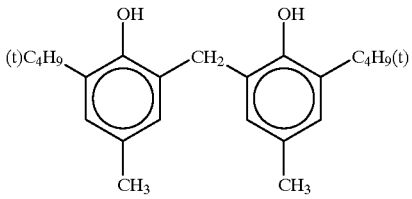
Cpd-3
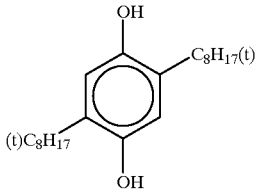

-continued
Cpd-4
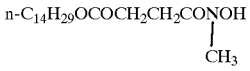
UV-1
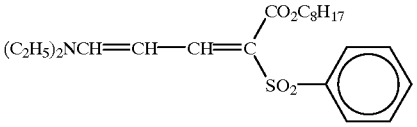
UV-2
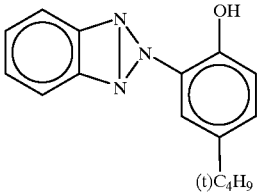
UV-3
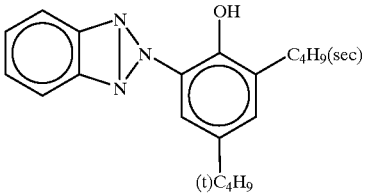
UV-4
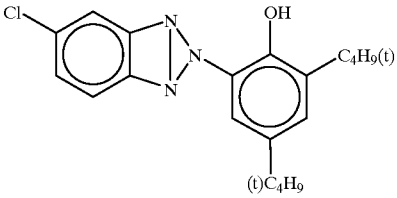
HBS-1
Tricresyl phosphate
HBS-2
Di-n-butyl phthalate
HBS-3
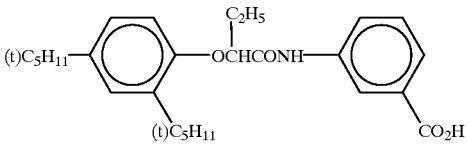
HBS-4
Tri(2-ethylhexyl)phosphate
ExS-1
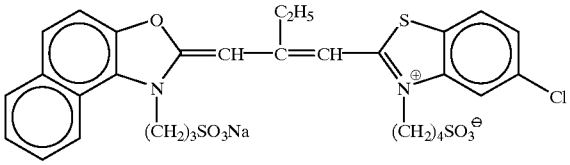
ExS-2
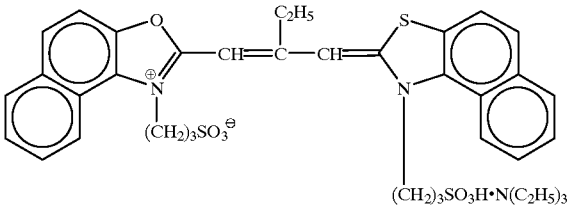

-continued
ExS-3
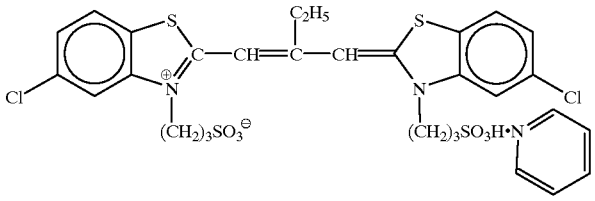
ExS-4
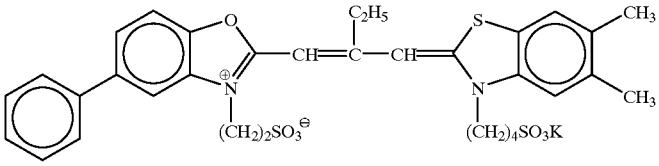
ExS-5
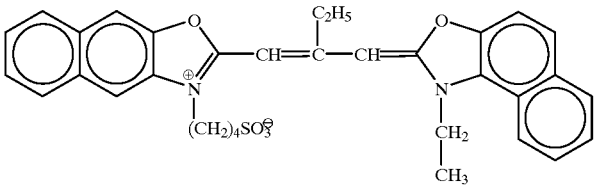
ExS-6
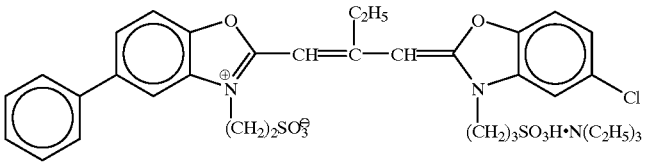
ExS-7
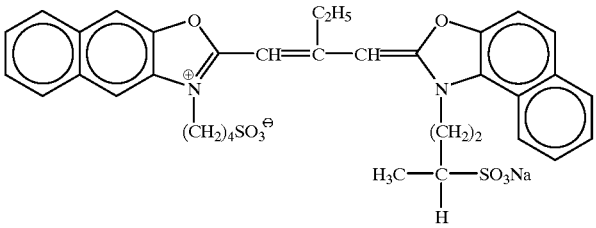
ExS-8
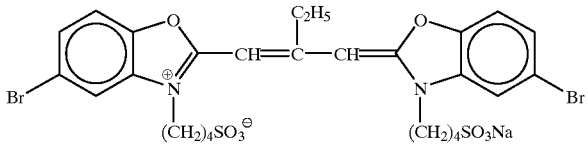
ExS-9
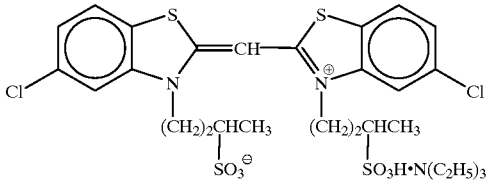
ES-1
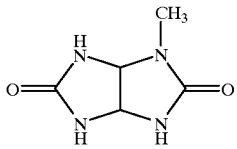

-continued
H-1
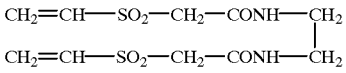
B-1
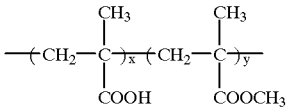
x/y = 10/90
Av.mol.wt.:35,000
B-2
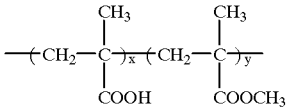
x/y = 40/60
Av.mol.wt.:20,000
B-3
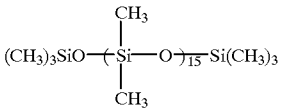
B-4
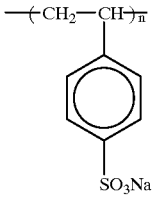
Av.mol.wt.:750,000
B-5
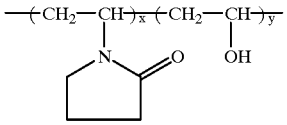
x/y = 70/30
Av.mol.wt.:7,000
B-6
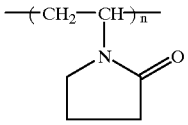
Av.mol.wt.:10,000
W-1
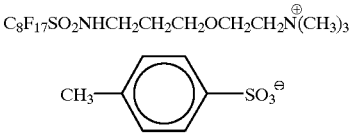
W-2
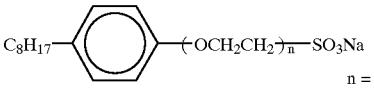
n = 2–4
W-3
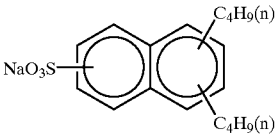

-continued
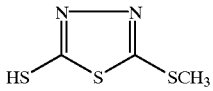
F-1
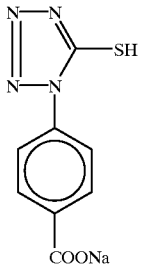
F-2
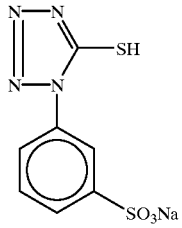
F-3
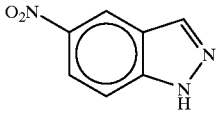
F-4
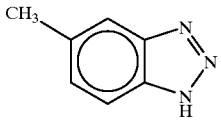
F-5
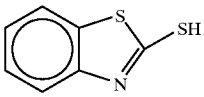
F-6
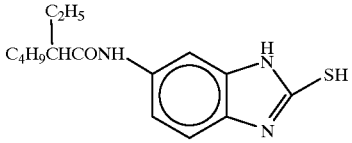
F-7
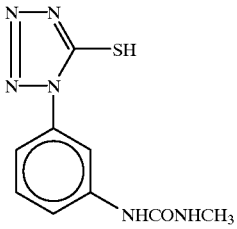
F-8
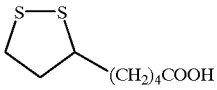
F-9
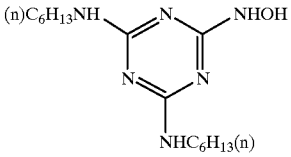
F-10
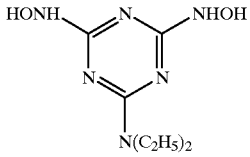
F-11
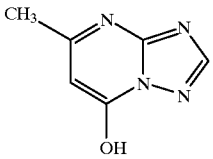
F-12
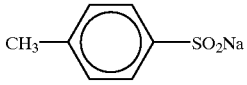
F-13
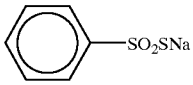
F-14
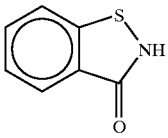
F-15
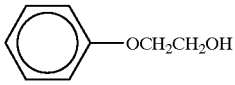
F-16

-continued

F-17

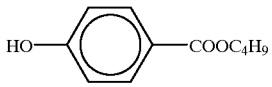

F-18

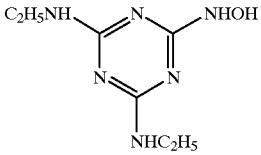

(Preparation of emulsions)

Emulsions A-2 to A-4, B-2 to B-4, C-2 to C-4, D-2 to D-4, and E-2 to E-4 were prepared by adjusting the calcium and magnesium concentrations in the emulsions A-1, B-1, C-1, D-1, and E-1 of the sample 301 as shown in Table 4. The calcium and magnesium concentrations were adjusted by adding calcium nitrate and magnesium nitrate after sensitizing dyes were added and before chemical sensitization was performed in the emulsion manufacturing process. The sensitizing dye addition amounts of these emulsions are shown by covering ratios (%) in Table 4. The covering ratio was calculated by the ratio of the total number of moles of ExS-1, ExS-2, and ExS-3 to the saturated covering amount calculated for the sensitizing dye ExS-3.

TABLE 4

| Emulsion | Addition amount of spectral sensitizing dye (covering ratio (%)) | Ca concentration (ppm) | Mg concentration (ppm) |
|---|---|---|---|
| A-1 | 79 | 250 | 8 |
| A-2 | 79 | 1000 | 8 |
| A-3 | 79 | 250 | 1000 |
| A-4 | 79 | 500 | 500 |
| B-1 | 83 | 245 | 8 |
| B-2 | 83 | 1000 | 8 |
| B-3 | 83 | 245 | 1000 |
| B-4 | 83 | 500 | 500 |
| C-1 | 76 | 260 | 10 |
| C-2 | 76 | 1000 | 10 |
| C-3 | 76 | 240 | 1000 |
| C-4 | 76 | 500 | 500 |
| D-1 | 85 | 240 | 9 |
| D-2 | 85 | 1000 | 9 |
| D-3 | 85 | 280 | 1000 |
| D-4 | 85 | 500 | 500 |
| E-1 | 81 | 255 | 9 |
| E-2 | 81 | 1000 | 9 |
| E-3 | 81 | 255 | 1000 |
| E-4 | 81 | 500 | 500 |

(Preparation of samples 302 to 304)

Samples 302 to 304 were prepared following the same procedures as for the sample 301, except that the emulsions A-1, B-1, C-1, D-1, and E-1 in the fourth to sixth layers were replaced with emulsions shown in Table 5 such that the silver coating amounts in these layers were the same as in the sample 301.

(Evaluation of aggregation)

Sectional electron micrographs of the resultant samples were taken at a magnification of ×3,000, and the numbers of aggregates of silver halide grains in the red-sensitive layers (4th layer and 5th layer) were counted in the same manner as in Example 1. The average numbers in three visual fields are summarized in Table 5 below.

TABLE 5

| Sample No. | Emulsion in 4th layer | Emulsion in 5th layer | Emulsion in 6th layer | Number of aggregation in red-sensitive emulsion layer | |
|---|---|---|---|---|---|
| 301 | A-1<br>B-1<br>C-1 | C-1<br>D-1 | E-1 | 13 | Comparison |
| 302 | A-2<br>B-2<br>C-2 | C-2<br>D-2 | E-2 | 8 | Invention |
| 303 | A-3<br>B-3<br>C-3 | C-3<br>D-3 | E-3 | 9 | Invention |
| 304 | A-4<br>B-4<br>C-4 | C-4<br>D-4 | E-4 | 4 | Invention |

Table 5 shows that the aggregates were very few in the samples using the emulsions of the present invention.

Also, comparison of the sample 302 with the sample 303 indicates that the effect of the present invention can be obtained with a smaller addition amount when calcium is used.

Similar results were obtained when the emulsions A-1 to E-1 were added to the green-sensitive layers (8th layer to 10th layer) or blue-sensitive layers (12th layer and 13th layer), instead of the red-sensitive layers (4th and 5th layers), and replacing the emulsions A-1 to E-1 with emulsions A-2 to A-4, B-2 to B-4, C-2 to C-4, D-2 to D-4 and E-2 to E-4, in the same manner as in the preparation of the samples 302 to 304.

Additionally, the same samples as in this example except that the samples had no magnetic recording layer were made and tested. Consequently, results analogous to those of this example were obtained.

Example 4

An increase in the adsorbed gelatin amount in tabular silver halide emulsion grains resulting from calcium or magnesium will be described below.

As described previously, the amount of gelatin adsorbed to tabular silver halide grains was calculated as a relative change with respect to grains having insufficient calcium or magnesium concentration.

(Preparation of emulsions)

Emulsions EM-14 to EM-16 were prepared following the same procedure as for the emulsion EM-6 in Example 1 except that the calcium and magnesium concentrations were adjusted as shown in Table 6.

(Measurement of adsorbed gelatin amount)

5 g of a tabular silver halide emulsion shown in Table 6 were heated and dissolved at 40° C. 50 mL of hot water were added, and the heated solution was centrifugally separated at 3,000 to 4,000 rpm for 30 min by using an angle centrifuge, thereby precipitating grains. 50 mL of 40° C. hot water were added to the precipitated grains, and the grains were similarly centrifugally separated. This operation was performed one more time. The resultant grains were washed once with each of methanol and acetone in this order and dried to form a powder. The IR absorption of the powder was measured by an FT-IR spectrometer, and the area of absorption peak per unit weight of the amide absorption band (near 1,650 $cm^{-1}$) of gelatin was calculated. This powder was compressed into tablets, and the infrared absorption spectrum was measured by the FT-IR spectrometer. The area of the absorption peak per weight of the amide absorption band (near 1,650 $cm^{-1}$) of gelatin was calculated. This value is shown in Table 6 as a change in the adsorbed gelatin amount. EM-4 in which most grains aggregated is used as a reference.

TABLE 6

| Emulsion | Concentration in emulsion (ppm) Ca | Mg | Adsorbed gelation | |
|---|---|---|---|---|
| EM-4 | 240 | 9 | 1.00 | Comparison |
| EM-6 | 740 | 9 | 1.13 | Invention |
| EM-7 | 1500 | 9 | 1.21 | Invention |
| EM-14 | 490 | 9 | 1.11 | Invention |
| EM-15 | 2000 | 9 | 1.28 | Invention |
| EM-16 | 240 | 1500 | 1.19 | Invention |

As shown in Table 6, the adsorbed gelatin of grains increased when the calcium concentration was raised. It is estimated from this fact that the aggregation was inhibited because the protective colloidal properties improved by the increased adsorbed gelatin of grains.

Example 5

Adsorption of calcium or magnesium to silver halide grains in the presence of a sensitizing dye will be described below.

(Preparation of emulsions)

Emulsions EM-21 and EM-22 were prepared following the same procedures as for the emulsions EM-4 and EM-7, respectively in Example 1 except that no sensitizing dyes were added.

An emulsion EM-23 was prepared following the same procedure as for the emulsion EM-13 in Example 2 except that no sensitizing dyes were added.

(Measurements of calcium and magnesium adsorption amounts)

An emulsion shown in Table 7 was heated and precipitated in a centrifuge, and a fixed amount of the supernatant liquid was sampled. The calcium and magnesium concentrations in the supernatant liquid were determined by ICP emission spectral analysis. The differences from the total calcium and magnesium amounts in the emulsion are shown by ratios (%) as the amounts of calcium and magnesium adsorbed to grains in Table 7.

TABLE 7

| Emulsion | Spectral sensitizing dye | Concentration in emulsion (ppm) Ca | Mg | Ratio of adsorbed ion (%) | |
|---|---|---|---|---|---|
| EM-21 | none | 240 | 9 | 40 ($Ca^{2+}$) | Comparison |
| EM-4 | present | 240 | 9 | 75 ($Ca^{2+}$) | Comparison |
| EM-22 | none | 1500 | 9 | 43 ($Ca^{2+}$) | Comparison |
| EM-7 | present | 1500 | 9 | 91 ($Ca^{2+}$) | Invention |
| EM-23 | none | 240 | 1500 | 41 ($Mg^{2+}$) | Comparison |
| EM-13 | present | 240 | 1500 | 88 ($Mg^{2+}$) | Invention |

It is evident from Table 7 that the adsorption of calcium and magnesium to silver halide grains was accelerated by the existence of sensitizing dyes. Table 7 also shows that the amounts of adsorbed calcium and magnesium increased when the calcium and magnesium concentrations in the emulsion were high.

Accordingly, the present inventors estimate that calcium and magnesium interacted with both of sensitizing dyes and gelatin to improve the protective colloidal properties of tabular silver halide grains.

Example 6

An emulsion was prepared following the same procedure as for the emulsion EM-7 in Example 1 except that calcium added to EM-7 was replaced with equal moles of zinc nitrate. The aggregated state of this emulsion was observed in the same manner as in Example 1. Consequently, even when zinc ions were added, aggregation equivalent to that of EM-4 before the calcium amount was increased was observed, so no aggregation inhibiting effect was found.

German Patent No. 4,404,003 has disclosed a silver halide emulsion preparation method by which sensitizing dyes and multivalent metal ions are added after chemical ripening. However, aggregation of tabular grains is not described in this German patent, so the aggregation inhibiting effect of calcium and magnesium cannot be inferred from the disclosure of the document.

The present invention has eliminated aggregation of silver halide grains which is a problem when spectral sensitization is performed by adding a large amount of a cyanine dye, while maintaining a high sensitivity/graininess ratio achieved by the addition of the cyanine dye and the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for producing a silver halide photographic emulsion comprising a step of spectrally sensitizing a silver halide photographic emulsion, wherein the emulsion contains tabular silver halide grains having an aspect ratio of 3 or more in an amount of 50% or more of the total projected area of all the silver halide grains in the emulsion; the spectral sensitization is performed by adding a cyanine dye in an amount of 60% or more of the saturated covering amount of the silver halide grains in the emulsion; and the emulsion is produced in the presence of (a) 400 to 2,500 ppm of calcium ions and 50 to 2,500 ppm of magnesium ions, or (b) 50 to 2,500 ppm of magnesium ions.

2. The method according to claim 1, wherein the cyanine dye is represented by formula (I):

(I)

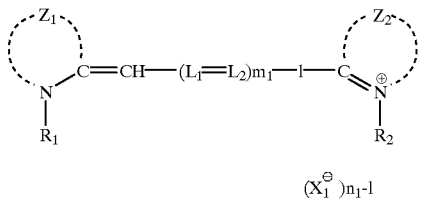

wherein, each of $Z_1$ and $Z_2$ independently represents a heterocyclic nucleus; each of $L_1$ and $L_2$ independently represents a methine group or a substituted methine group; each of $R_1$ and $R_2$ represents a 1- to 5-carbon alkyl group, a substituted alkyl group having a carboxy group, or a substituted alkyl group having a sulfo group; $m_1$ represents 1, 2, or 3; $X_1^-$ represents iodine ion, bromine ion, or an acid anion group; and $n_1$ represents 1 or 2.

3. The method according to claim 2, wherein $m_1$ is 2.

4. The method according to claim 1, wherein the addition amount of the cyanine dye is 75 to 100% of the saturated covering amount.

5. The method according to claim 1, wherein the amount of the tabular silver halide grains having an aspect ratio of 3 or more is 80% or more.

6. The method according to claim 1, wherein the emulsion is produced in the presence of 50 to 2,500 ppm of magnesium ions.

7. A silver halide emulsion containing silver halide grains, wherein the silver halide grains are produced by adding (a) a calcium salt and a magnesium salt or (b) a magnesium salt in an effective amount to inhibit aggregation of the silver halide grains.

8. The emulsion according to claim 7, wherein the grains are produced by adding a magnesium salt.

9. A method for inhibiting aggregation of a silver halide photographic emulsion comprising a step of spectrally sensitizing a silver halide emulsion and a step of adding (a) a calcium salt and magnesium salt or (b) a magnesium salt to the emulsion, wherein the emulsion contains tabular silver halide grains having an aspect ratio of 3 or more in an amount of 50% or more of the total projected area of all the grains in the emulsion;

the spectral sensitizing step is performed by adding a cyanine dye in an amount of 60% or more of the saturated covering amount of the silver halide grains in the emulsion material; and the step of adding (a) the calcium salt and magnesium salt or (b) the magnesium salt is performed during the step of spectral sensitization, and the addition amount of the calcium salt and the magnesium salt is so adjusted that (a) the calcium ion content and the magnesium ion content during the spectral sensitization are 400 to 2,500 ppm and 50 to 2,500 ppm, respectively or (b) the magnesium ion content during the spectral sensitization is 50 to 2,500 ppm.

10. The method according to claim 9, wherein the cyanine dye is represented by formula (I):

(I)

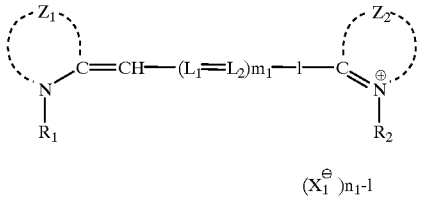

wherein, each of $Z_1$ and $Z_2$ independently represents a heterocyclic nucleus; each of $L_1$ and $L_2$ independently represents a methine group or a substituted methine group; each of $R_1$ and $R_2$ represents a 1- to 5-carbon alkyl group, a substituted alkyl group having a carboxy group, or a substituted alkyl group having a sulfo group; $m_1$ represents 1, 2, or 3; $X_1^-$ represents iodine ion, bromine ion, or an acid anion group; and $n_1$ represents 1 or 2.

11. The method according to claim 10, wherein $m_1$ is 2.

12. The method according to claim 9, wherein the addition amount of the cyanine dye is 75 to 100% of the saturated covering amount.

13. The method according to claim 9, wherein the amount of the tabular silver halide grains having an aspect ratio of 3 or more is 80% or more.

14. A method for inhibiting aggregation of a silver halide photographic emulsion comprising a step of spectrally sensitizing a silver halide emulsion and a step of adding a magnesium salt to the emulsion, wherein the emulsion contains tabular silver halide grains having an aspect ratio of 3 or more in an amount of 50% or more of the total projected area of all the grains in the emulsion;

the spectral sensitizing step is performed by adding a cyanine dye in an amount of 60% or more of the saturated covering amount of the silver halide grains in the emulsion; and the step of adding the magnesium salt is performed during the step of spectral sensitization, and the addition amount of the magnesium salt is so adjusted that the magnesium ion content during the spectral sensitization is 50 to 2,500 ppm.

* * * * *